US008205366B2

(12) United States Patent
Condor

(10) Patent No.: US 8,205,366 B2
(45) Date of Patent: Jun. 26, 2012

(54) SNAP MOBILE FOR ADVERTISING A PRODUCT OR EVENT

(75) Inventor: Paula F. Condor, Oshkosh, WI (US)

(73) Assignee: Promo Print Solutions, Inc., Oshkosh, WI (US)

( * ) Notice: Subject to any disclaimer, the term of this patent is extended or adjusted under 35 U.S.C. 154(b) by 338 days.

(21) Appl. No.: 12/658,674

(22) Filed: Feb. 12, 2010

(65) Prior Publication Data

US 2010/0146828 A1 Jun. 17, 2010

Related U.S. Application Data

(63) Continuation-in-part of application No. 11/900,077, filed on Sep. 10, 2007, now abandoned.

(51) Int. Cl.
*G09F 1/00* (2006.01)

(52) U.S. Cl. ..... 40/124.09; 40/539; 428/9

(58) Field of Classification Search ..... 40/124.09, 40/124.14, 124.15, 124.19, 539; 434/365, 434/428, 430, 385; 446/80, 227, 487, 488; 428/12, 9, 3, 542.8, 12.9
See application file for complete search history.

(56) References Cited

U.S. PATENT DOCUMENTS

| | | | | | |
|---|---|---|---|---|---|
| 1,411,022 | A | | 3/1922 | Heidenreich | |
| 1,891,009 | A | | 12/1932 | Phelps | |
| 2,099,420 | A | | 11/1937 | Cloud | |
| 2,616,199 | A | * | 11/1952 | Robins | 428/9 |
| 2,631,046 | A | | 3/1953 | Stephens | |
| 2,725,651 | A | * | 12/1955 | Spear | 40/124.13 |
| 3,912,079 | A | * | 10/1975 | Selchow, Jr. | 206/463 |
| 4,171,790 | A | | 10/1979 | Crescenti | |
| 4,462,178 | A | | 7/1984 | Freeman | |
| 4,531,564 | A | | 7/1985 | Hanna | |
| 4,773,622 | A | | 9/1988 | Herlin | |
| 4,784,277 | A | | 11/1988 | Wallish et al. | |
| 5,000,717 | A | * | 3/1991 | Pfeiffer | 446/488 |
| 5,048,677 | A | | 9/1991 | Pedracine | |
| 5,418,020 | A | * | 5/1995 | Crane | 428/12 |
| 5,433,326 | A | | 7/1995 | Horian | |
| 5,458,242 | A | | 10/1995 | Baka et al. | |
| 5,597,114 | A | | 1/1997 | Kramedjian et al. | |
| 5,778,578 | A | | 7/1998 | Drapcho et al. | |
| 5,983,538 | A | | 11/1999 | Crowell | |
| 5,992,071 | A | | 11/1999 | Dahlquist | |
| 6,109,329 | A | | 8/2000 | Russo | |
| 6,234,326 | B1 | | 5/2001 | Higgins et al. | |
| 6,360,465 | B1 | | 3/2002 | Simpson | |
| 6,394,290 | B1 | | 5/2002 | Walsh et al. | |
| 6,467,209 | B1 | | 10/2002 | Vickers | |
| 6,704,971 | B2 | | 3/2004 | Dossett et al. | |
| 6,712,227 | B2 | | 3/2004 | Blumreich et al. | |
| 6,953,118 | B2 | | 10/2005 | Seno et al. | |
| 7,000,881 | B2 | | 2/2006 | Fell | |

(Continued)

*Primary Examiner* — Lesley D Morris
*Assistant Examiner* — Shin Kim
(74) *Attorney, Agent, or Firm* — Thomas J. Connelly; Wilhelm Law, S.C.

(57) ABSTRACT

A snap mobile is disclosed for advertising a product or event and includes a display card having a first printed surface and an oppositely aligned second surface. The display card has a width divided by at least five score lines into first, second, third, fourth, fifth and sixth panels, with the first and sixth panels having an equal width. The snap mobile contains no adhesive between the second, third, fourth and fifth panels. This lack of adhesive enables the snap mobile to be manipulated into three separate and distinct positions after the first panel is secured to the sixth panel.

20 Claims, 10 Drawing Sheets

U.S. PATENT DOCUMENTS

| | | | |
|---|---|---|---|
| 7,111,736 | B2 | 9/2006 | Petter |
| 7,182,305 | B2 | 2/2007 | Dempsey |
| 7,191,555 | B2 | 3/2007 | Hughes |
| 7,200,960 | B1 | 4/2007 | Waggoner et al. |
| 7,225,573 | B2 | 6/2007 | Shaffer |
| 2004/0151874 | A1 | 8/2004 | Cowie |

* cited by examiner

SNAP MOBILE FOR ADVERTISING A PRODUCT OR EVENT

CROSS-REFERENCE TO RELATED APPLICATIONS

This application is a Continuation-In-Part application which claims priority under 35 U.S.C. §120 to application Ser. No. 11/900,077, filed Sep. 10, 2007.

FIELD OF THE INVENTION

This invention relates to a snap mobile for advertising a product or event. More specifically, this invention relates to a snap mobile that can be hung from an elevated member, be positioned on a shelf, counter or be situated on the floor, for example, at the end of an aisle, for advertising one or more products or events.

BACKGROUND OF THE INVENTION

Today, there are a wide variety of product displays used to advertise various products, articles and/or events. Such product displays are normally formed from cardboard, pasteboard or stiff paper and can be constructed in various sizes and shapes. The product displays are usually printed to include information in the form of words, letters, numbers, paragraphs, graphics, images, photos, etc. or combination thereof, urging a consumer to purchase a particular product, article or to take in a specific event, such as a movie. These product displays can appear in a grocery store, for example, as a stand up display at the end of an aisle, in a convenience store as a countertop display, or in a car dealer's showroom as a full size display or a smaller version that hangs down from a ceiling. Such product displays can also be hung from a shelf, from a ceiling or even from another display. The snap mobiles can further be displayed as a pole topper or as a display topper. Such snap mobiles are commonly used to promote various items, including but not limited to: the sale of soft drinks, bottled water, beer, alcohol, food items, especially candy or sweets, disposable products, movies, music, compact disks, cars, trucks, bicycles, etc.

One drawback with some such product displays is that they are one dimensional. In other words, they can be viewed from only one side. The side edges of such product displays are very narrow, usually ⅛ of an inch or less and the back surface of these product displays is not printed and carries no advertisement. In fact, the back surface of these product displays is normally positioned adjacent to a wall or a stationary object such that it is not readily visible to the consumer.

Other product displays contain printing on two opposing surfaces but require a base or stand to hold the product display in a vertical and upright position. The base or stand has to be made of a material that is sufficiently strong and sturdy to hold the product display. Many bases and stands project outward from the product display and a potential consumer can easily trip over or step on such supports. This presents a safety hazard. In addition, the cost of manufacturing the base or stands can greatly increase the total cost of the product display.

Still other product displays come with multiple sides and unique geometrical shapes. These product displays can be viewed from various directions, some can be viewed from 360 degrees. These product displays are more likely to be seen and read by potential consumers and can lead to increased sales for a retailer and the original product manufacturer. However, many of these multisided product displays can not be folded into a relatively flat orientation for shipment to the retailer. Because of this, the shipping cost can become excessive. Another drawback is that many of these multisided product displays need to be assembled at the retailer in order for them to stand up properly. This can be a time consuming and difficult task that no one enjoys doing. Feedback to advertisers has indicated that up to 40 percent of all corrugated displays that are shipped to retail stores are not used because of the time and complexity required to set them up.

Therefore, there is a need for a multisided product display that can be folded into a relatively flat orientation for shipping to the retailer, which is quick and easy to assemble, and which will be sturdy enough to maintain its assembled configuration.

SUMMARY OF THE INVENTION

Briefly, this invention relates to a snap mobile for advertising a product or event. The snap mobile includes a display card formed from a single material having a first printed surface and an oppositely aligned second surface. The display card has a length, a width and a thickness with the width being greater than the length. The width is divided by at least five score lines into a first panel, a second panel, a third panel, a fourth panel, a fifth panel and a sixth panel. The first and sixth panels have an equal width. Each of the score lines extends along the length of the display card and one of the at least five score lines is formed at a midsection of the width of the display card. The score line formed at the midsection is an intermittent score line having a plurality of land areas each separated by a perforation which extends completely through the thickness. The intermittent score line permits the third and fourth panels to be inverted onto the second and fifth panels. The snap mobile has an adhesive which secures the second surface of the first panel to the second surface of the sixth panel once the sixth panel is overlaid onto the first panel to form a first member. The first member has a height equal to the length of the display card and the first member has a top edge. The second, third, fourth and fifth panels of the snap mobile are capable of moving relative to one another to enable the snap mobile to acquire three separate and distinct first, second and third positions after the first member is formed. When the snap mobile is in the first position, the first surface of the second panel is aligned at an acute angle to the first surface of the first panel, the first surface of the third panel is aligned at a reflex angle to the first surface of the second panel, the first surface of the fourth panel is aligned at a reflex angle to the first surface of the third panel, the first surface of the fifth panel is aligned at a reflex angle to the first surface of the fourth panel, and the first surface of the sixth panel is aligned at an acute angle to the first surface of the fifth panel to form a hollow cavity completely surrounded by the second, third, fourth and fifth panels. The hollow cavity has a central axis aligned parallel to the height of the first member. When the snap mobile is in the second position, the third panel overlays the fourth panel to form a second member and the second panel overlays the fifth panel to form a third member. The first, second and third members are aligned at an obtuse angle relative to each other. The second, third, fourth and fifth panels are void of any attachment mechanism which would directly secure the second panel to the fifth panel and the third panel to the fourth panel. When the snap mobile is in the third position, the second member overlays the third member and the second and third members are aligned adjacent to the first member. The third position facilitates shipping of the snap mobile. The snap mobile is capable of reverting from the third position back to the second position and from the second position back to the first position.

In another embodiment, the snap mobile uses an adhesive to secure the second surface of the first panel to the second surface of the sixth panel to form the first member once the first panel is overlaid on the sixth panel.

In yet another embodiment, the snap mobile has first and sixth panels of equal width, second and third panels of equal width, and fourth and fifth panels of equal width. These three pairs of panels form first, second and third members which intersect one another. In addition, an aperture is formed in each of the panels. The apertures formed in the first and second panels, the apertures formed in the third and fourth panels, and the apertures formed in the fifth and sixth panels are mirror images of one another. Furthermore, the apertures formed in the six panels cooperate to create a three dimensional profile located at the intersection of the first, second and third members which is capable of holding or supporting a three-dimension article.

The general object of this invention is to provide a snap mobile for advertising a product, article or event that can be viewed from various angles. A more specific object of this invention is to provide a snap mobile that can be folded into a relatively flat orientation for shipment to a retailer and then can be quickly and easily assembled into a sturdy product display having at least three members.

Another object of this invention is to provide a snap mobile for advertising a product, article or event that can be positioned on the floor, on a shelf, on a countertop, or be hung from the ceiling or from an elevated member.

Still another object of this invention is to provide a snap mobile for advertising a product, article or event that can stand by itself without the need for a base or stand.

Still another object of this invention is to provide a snap mobile that can acquire three separate and distinct positions after the first member is formed and can be reverted from the third position back to the second position and from the second position back to the first position.

Still further, an object of this invention is to provide a snap mobile for advertising a product, article or event that has a unique intermittent score line that permits a portion of the snap mobile to be inverted upon itself to form a multisided product display having at least three members.

Still another object of this invention is to provide a snap mobile that can be mounted on a pole and be used as a pole topper or display topper for advertising a product, article or event.

These and other objects and advantageous of the present invention will be apparent from the embodiments described herein.

DETAILED DESCRIPTION OF THE INVENTION

Figure 1:
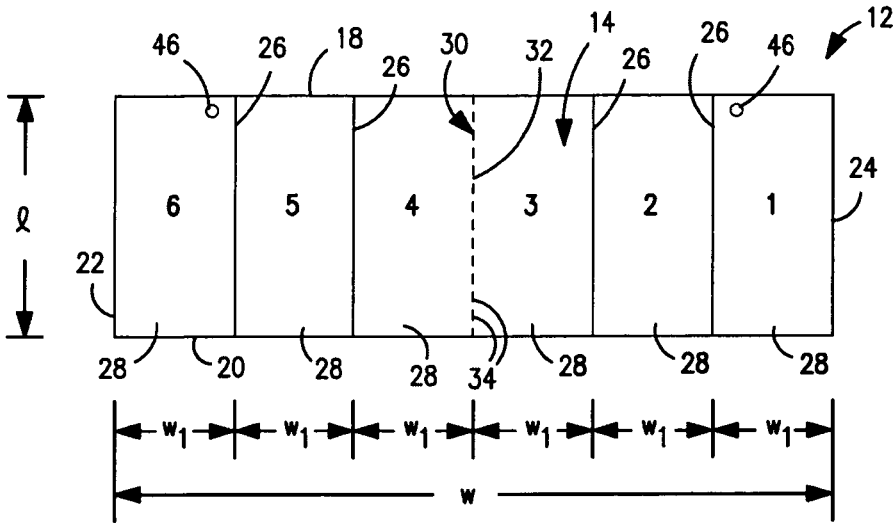
FIG. 1 is a front view of a display card having six panels and which is used to construct a snap mobile.
Figure 2:
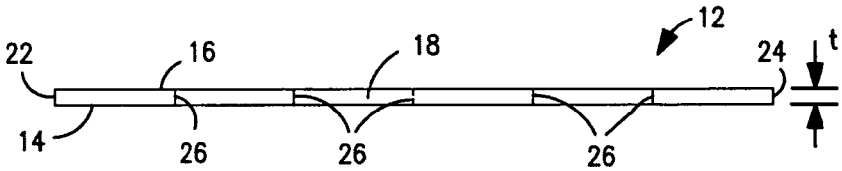
FIG. 2 is a top view of the display card shown in FIG. 1.
Figure 3:
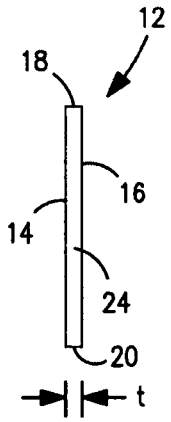
FIG. 3 is an end view of the display card shown in FIG. 1.
Figure 4:
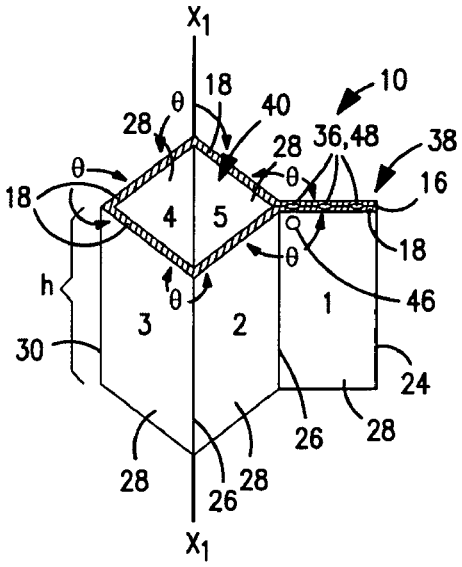
FIG. 4 is a perspective view of the snap mobile formed from the display card shown in FIG. 1 once the sixth panel is folded onto the first panel and is attached thereto.
Figure 5:
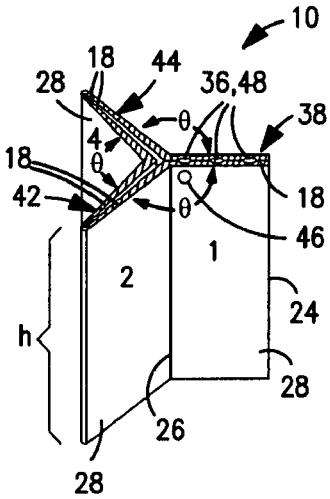
FIG. 5 is a perspective view of the snap mobile shown in FIG. 4 after the third and fourth panels are inverted onto the second and fifth panels, respectively.
Figure 6:
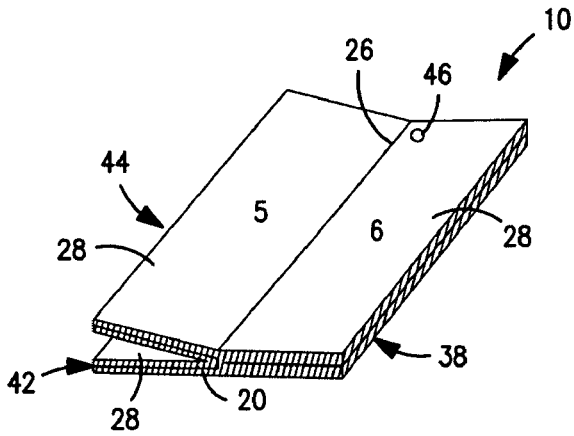
FIG. 6 is a perspective view of the snap mobile shown in FIG. 5 when in a folded configuration.
Figure 7:
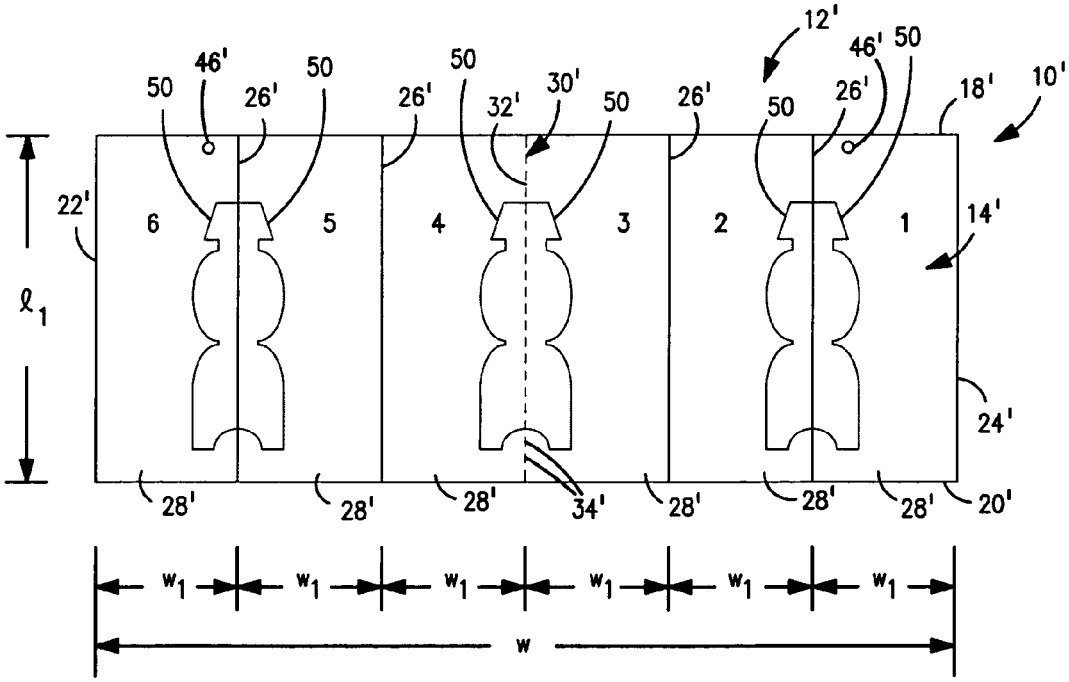
FIG. 7 is a front view of an alternative embodiment of a display card having six panels and which is used to construct a snap mobile having an aperture formed therein.

Referring to FIGS. 1-6, a snap mobile 10, see FIGS. 4-6, is formed from a display card 12, see FIGS. 1-3. The snap mobile 10 is a display for advertising a product, article and/or event. The snap mobile 10 is formed from the display card 12. The display card 12 can be formed or manufactured from a single material or from two or more materials. Desirably, the display card is formed from a single material. More desirably, the single material is opaque. The display card 12 has a first surface 14 and an oppositely aligned second surface 16, see FIGS. 2 and 3. Desirably, the first surface 14 is fairly smooth and is acceptable to having information printed thereon. The second surface can also be smooth. The first surface 14 can be printed before being cut, scored or folded or can be printed after it is cut, scored or folded. The second surface 16 commonly is left blank and therefore is void of printed matter. Alternatively, the second surface 16 can also be printed so that when the display card 12 is cut and/or folded, the color of the non-printed material will not be visible to the ultimate consumer. Another option is to color the material which forms the second surface 16 so that it is of one color, such as white.

The display card 12 has a thickness t measured between the first and second surfaces, 14 and 16 respectively. The thickness t can range from about 1 millimeter to about 10 millimeters. Desirably, the thickness t is less than about 7 millimeters. More desirably, the thickness t is less than about 5 millimeters. Even more desirably, the paperboard has a thickness t of 15 points, 18 points, 20 points or 24 points. Alternatively, the snap mobile 10 can be constructed from paperboard stock ranging in thickness t of from between about 6 points to about 40 points. Other options include constructing the snap mobile 10 out of paper, stiff paper, synthetic paper, paperboard, cardboard, corrugate, COROPLAST®, plastic corrugate, any flute material, or out of some other material known to those skilled in the art. It is more advantageous to construct larger size snap mobiles 10 out of corrugate. The display card 12 can also be formed as a composite having two or more layers. One or more of the layers can be formed from a different material from another of the layers. For example, the display card 12 can be a three layer structure consisting of a corrugated central layer sandwiched between two layers of paper.

The display card 12 can have almost any geometrical shape. In FIG. 1, the display card 12 is depicted as a rectangle having a length l and a width w. Desirably, the width w is greater than the length l. The length l will be associated with the height h of the snap mobile 10. The rectangle can be cut from an elongated strip of pre-printed material which is unwound from a supply roll or it can be cut out of individual sheets. The length l and the width w of the display card 12 can vary to suit one's particular needs. The length l can range from a couple of inches to several feet, and the width w can range from a couple of inches to several feet. For example, some snap mobiles 10 have been constructed to be 6 feet long and 6 feet wide. The display card 12 also has a top edge 18, a bottom edge 20 and a pair of side edges 22 and 24. The top edge 18, the bottom edge 20 and/or the side edges 22 and 24 can be linear or non-linear in configuration. It should be understood that if the snap mobile 10 is to be placed on a countertop, then at least a portion of the bottom edge 20 should be linear and horizontal so as to permit the snap mobile 10 to stand upright without requiring additional support. Alternatively, two or more points on the bottom edge 20 of the snap mobile 10 can serve as feet to allow the snap mobile 10 to stand upright.

The display card 12 can be formed from any known material, but usually it is formed from a material that is relatively light weight. The material should also have a smooth surface that is easy to print information on. The information can be in the form of letters, numbers, words, sentences, paragraphs, an image, an icon, a graphic, a photograph, etc. Examples of such materials from which the display card 12 can be formed include, but are not limited to: paper, stiff paper, synthetic paper, paperboard, cardboard, pasteboard, corrugate, COROPLAST®, plastic corrugate, corrugated paper attached to a smooth sheet or sandwiched between two smooth sheets, etc. The display card 12 can also be formed from plastic, plastic corrugate, styrene, foam, a lightweight core sandwiched between two sheets of thin paper, or from a combination of such materials. In addition, the display card 12 can be constructed from a light weight material, such as styrene, foam, solid bleached sulfate and the like, which is secured to one or two paper sheets. Desirably, the snap mobile 10 is formed from a display card 12 that is made from paper, stiff paper, synthetic paper, paperboard, cardboard, pasteboard, corrugate, COROPLAST®, plastic corrugate, or corrugated paper sandwiched between two sheets of paper. For a harsh environment, such as for an outdoor display or in a cooler, the display card 12 can be constructed out of plastic or synthetic material.

It should be understood that the snap mobile 10 can be constructed such that it is free of plastic film or thermoplastic film. In this case, no film of any kind is secured or attached to the display card 12. One reason for not attaching a plastic film to a paper display card is to make it easier to recycle the material from which the snap mobile 10 is formed.

As mentioned above, the first surface 14 of the display card 12 should be smooth and acceptable to having information printed on it. Various printing techniques known to those skilled in the printing arts can be used. The display card 12 should also be formed from a material that is easy to cut and fold. For example, the display card 12 should be acceptable to being cut by a die, by a die cutter, by a knife or the like, and should be acceptable to being easily folded along one or more predetermined score lines.

Still referring to FIG. 1, the display card 12 is divided along its width w by at least five score lines 26 into at least six panels 28. The six panels 28 are numbered 1, 2, 3, 4, 5, and 6 in FIG. 1 for the purpose of aiding the reader in understanding this invention. It is to be understood that eight, ten, twelve or more even numbered panels 28 can be utilized. For a display card 12 having an even number of panels 28, each panel will be separated by a score line 26. An odd number of score lines 26 will produce an even number of panels 28. The display card 12 can have five, seven, nine, eleven or more spaced apart score lines 26.

It is advantageous to pre-print the first surface 14 of the display card 12 before the score lines 26 are formed. However, if one wished to score the display card 12 prior to printing the first surface 14, this is certainly possible. Desirably, an odd number of score lines 26 are utilized which divide the display card 12 into an even number of panels 28. For example, as depicted in FIG. 1, five score lines 26 divide the display card 12 into six panels 28. Each of the panels 28 can have the same width $w_1$ or a different width. Desirably, the first and sixth panels 28, 28 have the same width $w_1$, the second and third panels 28, 28 have the same width $w_1$, and the fourth and fifth panels 28, 28 have the same width $w_1$. It should be understood that the width $w_1$ of the first and sixth panels, 28, 28 can be different from the width $w_1$ of the second and third panels 28, 28 or the width $w_1$ of the third and fourth panels 28, 28. More desirably, all the panels 28, numbered 1, 2, 3, 4, 5, and 6, have the same width $w_1$. Alternatively, the first and sixth panels 28, 28 can have a first width, the second and third panels 28, 28 have a second width, and the fourth and fifth panels 28, 28 have a third width, with the three widths being different. The width of the first and sixth panels 28, 28 do not have to be the same as the width of the second and third panels 28, 28, nor equal to the width of the fourth and fifth panels 28, 28.

The score lines 26 can be formed in the first surface 14, in the second surface 16, or in both the first and second surfaces, 14 and 16 respectively. Desirably, the score lines 26 are formed in the first surface 14 since this is the printed surface. The score lines 26 are spaced apart from one another. The score lines 26 can be linear in configuration, non-linear in configuration, arcuate in configuration or of some other geometrical profile. Desirably, each of the score lines 26 is linear. More desirably, each of the score lines 26 is aligned parallel to one another and in a spaced relationship.

By forming an odd number of score lines 26, one will end up with an even number of panels 28. Each of the score lines 26 extends inward into the thickness t of the display card 12 from at least one of the first or second surfaces, 14 or 16 respectively, by a distance ranging from between about 2% to about 90% of the thickness t. Desirably, each of the score lines 26 extends inward into the thickness t of the display card 12 from at least one of the first or second surfaces, 14 or 16 respectively, by a distance ranging from between about 10% to about 70% of the thickness t. More desirably, each of the score lines 26 extends inward into the thickness t of the display card 12 from at least one of the first or second surfaces, 14 or 16 respectively, by a distance ranging from between about 15% to about 50% of the thickness t. Even more desirably, each of the score lines 26 extends inward into the thickness t of the display card 12 from at least one of the first or second surfaces, 14 or 16 respectively, by a distance ranging from between about 20% to about 45% of the thickness t.

The score lines 26 are shown being formed in the first surface 14. However, in some situations, it may be advantageous to form the score lines 26 in the second surface 16. Alternatively, as mentioned above, one could form the score lines 26 in both the first and second surfaces, 14 and 16 respectively, of the display card 12. The score lines 26 can extend from the top edge 18 to the bottom edge 20 or they can extend over only a portion of this distance. Desirably, each of the score lines 26 will extend the full distance between the top edge 18 and the bottom edge 20. The score lines 26 do not have to intersect the top or bottom edges, 18 or 20, but desirably they do.

As shown in FIG. 1, the score lines 26 are linear lines that are aligned essentially parallel to one another. Desirably, each score line 26 is aligned parallel to an adjacent score line 26. A majority of the score lines 26 can be continuous straight lines formed by displacing the material from which the display card 12 is formed.

Still referring to FIG. 1, the display card 12 is divided into six panels 28. Each of the six panels 28 can have an identical configuration. The six panels 28 can be folded into a finished snap mobile 10 that can be viewed from multiple sides. Desirably, the snap mobile 10 can be viewed by a potential consumer from 360 degrees. Each of the six panels 28 has a width $w_1$. Desirably, the width $w_1$ of each of the six panels 28, labeled 1, 2, 3, 4, 5 and 6, are equal or approximately equal. The top edge 18 of each of the first, second and third panels 28, 28, 28, labeled #1, 2 and 3, can have a non-linear profile that is a mirror image of the top edge 18 of each of the fourth, fifth and sixth panels 28, 28, 28, labeled #4, 5 and 6. Likewise, the bottom edge 20 of each of the first, second and third panels 28, 28, 28, labeled #1, 2 and 3, can have a non-linear profile that is a mirror image of the bottom edge 20 of each of the fourth, fifth and sixth panels 28, 28, 28, labeled #4, 5 and 6.

The snap mobile 10 can include at least one intermittent score line 30 in place of one of the continuous score lines 26. The intermittent score line 30 is shown being formed in the first surface 14. Alternatively, the intermittent score line 30 could be formed in the second surface 16, or in both the first and second surfaces, 14 and 16 respectively, if desired. In FIG. 1, where six panels 28 are present, the intermittent score line 30 is shown being formed at a midsection of the width w of the display card 12. The intermittent score line 30 is aligned parallel with at least one of the other score lines 26, and desirably, is aligned parallel to each of the other score lines 26. The intermittent score line 30 extends approximately between the top edge 18 and the bottom edge 20, although it can extend over only a portion of this distance, if desired. Desirably, the intermittent score line 30 extends from the top edge 18 to the bottom edge 20. Desirably, the intermittent score line 30 is formed at a midsection of the width w of the display card 12.

The intermittent score line 30 is formed from a plurality of land areas 32 each separated by a perforation 34. By "perforation" it is meant a depression, a cut, a slot, a hole or series of depressions, cuts, slots, holes punched, bored or formed into or through something. The perforations 34 extend along the length l of the display card 12. The perforations 34 can be formed along a linear or a non-linear line. The perforations 34 can be formed in a series to separate sections in a sheet or sections of a roll of material. The land areas 32 are each separated by a perforation 34 in an intermittent fashion. By "intermittent" it is meant a line that starts and stops at intervals. The perforations 34 can, but do not have to, extend completely through the thickness t of the display card 12. Desirably, the perforations 34 do extend completely through the thickness of the display card 12.

The length of each of the plurality of land areas 32, as well as the length of each perforation 34, can vary. The length of each of the land areas 32 can be less than, equal to or be greater than the length of each of the perforations 34. Likewise, the total number of land areas 32 can be less than, equal to or be greater than the total number of perforations 34. Normally, the number of land areas 32 will be equal to the number of perforations 34 or the number of land areas 32 will be one less than or one more than the number of perforations 34. It is also possible to change the length of each of the land areas 32 and/or the length of the perforations 34 along the length of the intermittent score line 30. Typically, each of the land areas 32 will have a constant length dimension and each of the perforations 34 will have a constant length dimension. The length of each of the land areas 32 can range from between about 0.01 inches to about 2 inches. Desirably, the length of each of the land areas 32 can range from between about 0.05 inches to about 1 inch. More desirably, the length of each of the land areas 32 can range from between about 0.1 inches to about 0.5 inches. Even more desirably, the length of each of the land areas 32 can range from between about 0.125 inches to about 0.4 inches.

Likewise, the length of each of the perforations 34 can range from between about 0.01 inches to about 2 inches. Desirably, the length of each of the perforations 34 can range from between about 0.05 inches to about 1 inch. More desirably, the length of each of the perforations 34 can range from between about 0.1 inches to about 0.5 inches. Even more desirably, the length of each of the perforations 34 can range from between about 0.125 inches to about 0.4 inches.

Like the score lines 26, the intermittent score line 30 does not extend completely through the thickness t of the display card 12. However, one or more of the perforations 34 can extend completely through the thickness t of the display card 12. Desirably, all of the perforations 34 do extend through the thickness t of the display card 12. The intermittent score line 30 should extend inward from the first surface 14 a distance of from between about 2% to about 90% of the thickness t of the display card 12. Desirably, the intermittent score line 30 could extend inward from the first surface 14 a distance of from between about 10% to about 70% of the thickness t of the display card 12. More desirably, the intermittent score line 30 could extend inward from the first surface 14 a distance of from between about 15% to about 50% of the thickness t of the display card 12. Even more desirably, the intermittent score line 30 could extend inward from the first surface 14 a distance of from between about 20% to about 45% of the thickness t of the display card 12.

The intermittent score line 30 functions to permit the third and fourth panels 28, 28 (labeled #3 and 4) to be inverted upon the second and fifth panels, 28, 28, (labeled #2 and 5). It should be understood that one or more of the score lines 26 can be replaced with an intermittent score line 30. Alternatively, none of the score lines 26 have to be formed as an intermittent score line 30, if no inversion is to occur. Desirably, the display card 12 will have at least one intermittent score line 30. More desirably, the intermittent score line 32 is located at the midsection or middle of the width w of the display card 12.

Referring to FIG. 4, the snap mobile 10 also includes an attachment mechanism 36. The attachment mechanism 36 can be a chemical compound or formulation, such as an adhesive or glue, or be a mechanical fastener, such as one or more staples, pins, clips, etc. Desirably, the attachment mechanism 36 is an adhesive that can adhere or stick to a panel 28. The adhesive can be a hot melt adhesive, a cold melt adhesive, a co-adhesive, a paste, cement, glue, or any other adhesive known to those skilled in the art.

When the attachment mechanism 36 is an adhesive or glue, it can be applied to at least a portion of the second surface 16 of the first panel 28 and/or to at least a portion the second surface 16 of the sixth panel 28. The attachment mechanism 36, for example, an adhesive or glue, only has to be located between the first and sixth panels 28, 28, (labeled #1 and 6). The adhesive can be applied in various ways, including but not limited to: being coated, such as by line coating or slot coating, or be brushed, painted, applied in a swirl pattern, be applied as a spray or mist along with air or pressurized air, etc., onto the second surface 16 of the first and/or sixth panels 28, 28. Those familiar with adhesive and glue may know of still other ways to apply the adhesive.

It should be noted that the second surfaces 16 of the second, third, fourth and fifth panels 28, 28, 28 and 28 (labeled #2, 3, 4 and 5) are free of any attachment mechanism 36, i.e. adhesive. In other words, no adhesive is present on the second, third, fourth and fifth panels 28, 28, 28 and 28 (labeled #2, 3, 4 and 5) which can be used to secure that panel 28 to another panel 28.

When the attachment mechanism 36 is a mechanical fastener, such as pins, staples, clips, etc., they can be inserted or attached along the pair of side edges 22 and 24 to hold the first and sixth panels 28, labeled 1 and 6, together. Additional pins, staples, clips, etc. can also be applied to other areas of the display card 12, if needed. Those skilled in mechanical fasteners may know of various other apparatus and methods which can be used to attach the first and sixth panels 28, 28 together to form the configuration shown in FIG. 4.

Still referring to FIG. 4, the second surface 16 of the sixth panel 28, labeled #6, is folded over the second surface 16 of the first panel 28, labeled #1, to form a first member 38. The attachment mechanism 36, i.e. the adhesive, is applied before the sixth panel 28 is folded over the first panel 28. The folding can be done by hand or by using a mechanical folder. After the display card 12 has been folded upon itself and after the first and sixth panels are secured together, the snap mobile 10 is in its first position, as depicted in FIG. 4. The snap mobile 10 is capable of being manipulated into three separate and distinct positions which will be referred to as a first position, a second position and a third position. The snap mobile 10 also has the unique ability to revert from the third position back to the second position and to revert from the second position back to the first position.

The height h of the snap mobile 10 can be equal to the width w of one of the panels 28 or it can be lesser or greater than the width of a given panel 28. Desirably, the height of the snap mobile 10 is at least 1.5 times the width $w_1$ of one of the panels 28. More desirably, the height of the snap mobile 10 is at least two times the width $w_1$ of one of the panels 28. The snap mobile 10 can be displayed to consumers in the first or second positions. When the snap mobile 10 has the configuration of its first position, each of the second, third, fourth and fifth panels 28, 28, 28 and 28 (labeled #2, 3, 4 and 5), are aligned at an angle to the first member 38. The angle can vary to suit one's needs. This angle is shown as approximately 45° for the second and fifth panels 28, 28 (labeled #2 and 5), and 135° for the third and fourth panels 28, 28 (labeled #3 and 4). As stated above, the snap mobile 10 can be displayed in the configuration referred to as its first position. Furthermore, the second, third, fourth and fifth panels 28, 28, 28 and 28 (labeled #2, 3, 4 and 5), are arranged to form a hollow cavity or opening 40 therebetween. The hollow cavity 40 is configured to have a square cross-section.

When the snap mobile 10 is in its first position, the first surface 14 of the second panel 28 (labeled #2) is aligned at an acute angle to the first surface 14 of the first panel 28 (labeled #1). By an "acute angle" it is meant an angle of less than 90°. In the first position, the first surface 14 of the third panel 28 (labeled #3) is aligned at a reflex angle to the first surface 14 of the second panel 28 (labeled #2). By a "reflex angle" it is meant an angle between 180° and 360°. In the first position, the first surface 14 of the fourth panel 28 (labeled #4) is aligned at a reflex angle to the first surface 14 of the third panel 28 (labeled #3), the first surface 14 of the fifth panel 28 (labeled #5) is aligned at a reflex angle to the first surface 14 of the fourth panel 28 (labeled #4), and the first surface 14 of the sixth panel 28 (labeled #6) is aligned at an acute angle to the first surface 14 of the fifth panel 28 (labeled #5). When the snap mobile 10 is in its first position, a hollow cavity 40 is formed completely surrounded by the second, third, fourth and fifth panels 28 (labeled #2, 3, 4 and 5). The hollow cavity 40 has a central axis $X_1$-$X_1$ that is aligned parallel to the height of the first member 38. The hollow cavity 40 can have various geometrical shapes. A square cross-sectional shape is depicted in FIG. 4. However, the hollow cavity 40 can have a rectangular shape, if desired.

The second, third, fourth and fifth panels 28, 28, 28 and 28 (labeled #2, 3, 4 and 5) of the snap mobile 10 are capable of moving relative to one another to enable the snap mobile 10 to acquire the three separate and distinct first, second and third positions after the first member 38 is formed. Referring to FIG. 5, the snap mobile 10 is shown in its second position. When the snap mobile 10 is in its second position, the second panel 28 (labeled #2) overlays the third panel 28 (labeled #3) to form a second member 42 and the fourth panel 28 (labeled #4) overlays the fifth panel 28 (labeled #5) to form a third member 44. The first, second and third members 38, 42 and 44 are aligned at an obtuse angle relative to each other. By an "obtuse angle" it is meant an angle between 90° and 180°. The second, third, fourth and fifth panels 28, 28, 28 and 28 (labeled 2, 3, 4 and 5) are void of any attachment mechanism 36 which would directly secure the second panel 28 (labeled #2) to the third panel 28 (labeled #3), and the fourth panel 28 (labeled #4) to the fifth panel 28 (labeled #5).

Referring to FIG. 6, the snap mobile 10 is shown in its third position. When the snap mobile 10 is in its third position, the second member 42 overlays the third member 44. In addition, the second and third members, 42 and 44 respectively, are aligned adjacent to the first member 38. The third position facilitates shipping the snap mobile 10 since it is in a relatively flat configuration.

The snap mobile 10 is depicted as being in its first position in FIG. 4, in its second position in FIG. 5 and in its third position in FIG. 6. In its first position, the snap mobile 10 can be positioned on a horizontal surface, such as on a counter or shelf, and the snap mobile 10 is capable of standing upright by itself. The hollow cavity 40 provides the snap mobile 10 with stability.

The snap mobile 10 can be manipulated or folded further to create the configuration depicted in FIG. 5, referred to herein as the second position. In the second position, the hollow cavity 40 forms a three-dimensional profile having a predetermined size and shape which is stable and can support itself on a flat, horizontal surface.

The third and fourth panels 28, 28 (labeled #3 and 4) are inverted relative to the second and fifth panels 28, 28 (labeled #2 and 5) to create the profile exhibited in FIG. 5. By "inverted" it is meant to turn outside in or inside out. After the third and fourth panels 28, 28 (labeled #3 and 4) are inverted or folded onto the second and fifth panels 28, 28 (labeled #2 and 5), the first, second and third members, 38, 42 and 44 respectively, of the snap mobile 10 are aligned at an obtuse angle of 120° relative to one another. Desirably, the first, second and third members, 38, 42 and 44 respectively, are aligned at an obtuse angle of about 120° relative to one another.

It should be noted that at least a portion of the first panel 28 (labeled #1) is bonded to the sixth panel 28 (labeled #6) by the attachment mechanism 36. No attachment mechanism 36 is present between the second and third panels 28, 28 (labeled #2 and 3) or between the fourth and fifth panels 28, 28 (labeled #4 and 5). The snap mobile 10 will function just fine without the attachment mechanism 36 being present between the second and third panels 28, 28 (labeled #2 and 3) and between the fourth and fifth panels 28, 28 (labeled #4 and 5). The second, third, fourth and fifth panels 28, 28, 28 and 28 (labeled #2, 3, 4 and 5) will be retained upright, adjacent to one another, by the stiffness of the material from which the display card 12 is formed. The intermittent score line 30 and the other score lines 26 form creases as the display card 12 is bent or folded and these creases will also assist in allowing the snap mobile 10 to retain its shape while in the second position.

Referring again to FIG. 6, the snap mobile 10 is shown in its third position. In this third position, the snap mobile 10 is folded into a relatively flat orientation. This is the orientation it would have prior to being shipped to a retailer or customer. The flat orientation allows multiple snap mobiles 10 to be packaged and shipped in an efficient and economical manner. As depicted, the third member 44 is folded onto the second member 42 in an overlapping fashion and both are located adjacent to the first member 38. This produces a relatively flat two panel wide structure which is very compact.

It should be understood that the snap mobile 10 can be manipulated from its first position to its second position and then to its third position. The snap mobile 10 is also capable of being later reverted from its third position back to its second position, and from its second position back to its first position. The snap mobile 10 can be manipulated back and forth between the three positions multiple times, if desired. The snap mobile can stand upright in either its first or second positions. It should also be understood that the snap mobile 10 does not have to be manipulated from its second position to its third position. Once the snap mobile 10 is in its third position, it can be reverted back to its second position and then to its first position. However, the snap mobile 10 cannot be reverted directly from its third position to its first position without first moving through its second position.

Referring again to FIG. 1 and FIGS. 4-6, the snap mobile 10 can further include one or more small holes or openings 46 formed approximate the top edge 18. A hole 46 is depicted extending completely through the thickness t of the first panel 28 (labeled #1) and a second hole 46 is depicted extending completely through the thickness t of the sixth panel 28 (labeled #6). The two small holes 46, 46 are formed at locations such that as the sixth panel 28 (labeled #6) is folded and overlaid onto the first panel 28 (labeled #1), the two small holes 46, 46 will coaxially align with one another. In other words, the two holes 46, 46 create a single opening 46 in the first member 38 approximate the point where the first, second and third members, 38, 42 and 44 respectively, intersect. It should be understood that one or more small holes 46 can be formed through one or more of the other panels 28, if desired. The small holes 46 can be formed in the display card 12 before or after it is printed or in the snap mobile 10 after it is configured into the profile shown in FIG. 4 or 5. The two small holes 46, 46 are sized to receive a string, cord, wire, etc. so that the snap mobile 10 can be hung from an elevated member or structure. The elevated member or structure can be a ceiling, a rafter, a beam, the top of a display cabinet, etc., or a hook extending downward from such a structure.

The hole 46, which extends completely through the first member 38, is located or aligned adjacent to the top edge 18. Desirably, the hole 46 is located close to the point where the first, second and third members, 38, 42 and 44 respectively, intersect.

Referring now to FIGS. 7-10, another embodiment of a snap mobile 10' is shown. This snap mobile 10' is similar to the snap mobile 10 and identical numbers are used to designate the various components along with the prime sign (')). The snap mobile 10' is formed from a display card 12' formed from a single material having a first surface 14' and a second surface 16', see FIG. 8. The display card 12' has a length $l_1$ and a width w. The length $l_1$ is greater than the length l shown in FIG. 1 but the width w is equal to the width w shown in FIG. 1. The width w is greater than the length $l_1$. The first surface 14' contains printed matter while the oppositely aligned second surface 16' can be void of printed matter or may contain printed matter. The display card 12' has a top edge 18', a bottom edge 20', and a pair of side edges 22' and 24'. The display card 12' has a width w divided by at least five score lines 26' and 30' into a first panel 28', a second panel 28', a third panel 28', a fourth panel 28', a fifth panel 28' and a sixth panel 28'. The six panels 28' are labeled #1 , 2, 3, 4, 5, and 6. The first and sixth panels 28', 28' (labeled #1 and 6) have an equal width $w_1$, the second and third panels 28', 28' (labeled #2 and 3) have an equal width $w_1$, and the fourth and fifth panels 28', 28' (labeled #4 and 5) have an equal width $w_1$. In this embodiment, as in FIG. 1, all six panels 28' have the same width $w_1$. However, it should be understood that various pair of panels 28', 28' can be sized to have a different width.

One of the score lines 26' is an intermittent score line 30' having a plurality of land areas 32' each separated by a perforation 34'. The intermittent score line 30' is formed at a midsection of the width w of the display card 12'. The intermittent score line 30' facilitates bending and/or folding of the display card 12' such that the third and fourth panels 28', 28' (labeled #3 and 4) can be inverted onto the second and fifth panels 28', 28' (labeled #2 and 5).

Figure 8:
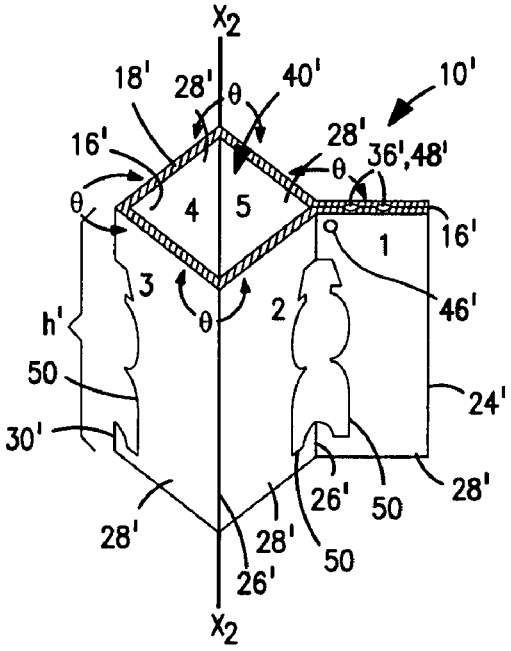
FIG. 8 is a perspective view of the snap mobile formed from the display card shown in FIG. 7 once the sixth panel is folded onto the first panel and is adhesively attached thereto.

Referring now to FIG. 8, the score lines 26' and/or 30' allow the snap mobile 10' to be folded such that the sixth panel 28' (labeled #6) can be overlaid on the first panel 28' (labeled #1). The second surface 16' of the first panel 28' (labeled #1) can be secured to the second surface 16' of the sixth panel 28' (labeled #6) by an attachment mechanism 36'. The attachment mechanism 36' can be an adhesive 48' or any of the other forms of attachments taught above. The adhesive 48' can be applied by any means known to those skilled in the art. The adhesive 48' can be applied to a portion of or cover the entire second surface 16' located between the first and sixth panels 28', 28' (labeled #1 and 6). Desirably, to reduce cost, only a portion of the second surface 16', located between the first and sixth panels 28', 28' (labeled #1 and 6), is coated with the adhesive 48'. Once the first and sixth panels 28', 28' (labeled #1 and 6) are joined together, a first member 38' is formed. As explained above with reference to FIGS. 1-6, the second panel 28' (labeled #2) is overlaid on the third panel 28' (labeled #3) to form a second member 42', and the fourth panel 28' (labeled #4) is overlaid on the fifth panel 28' (labeled #5) to form a third member 44'.

Figure 9:
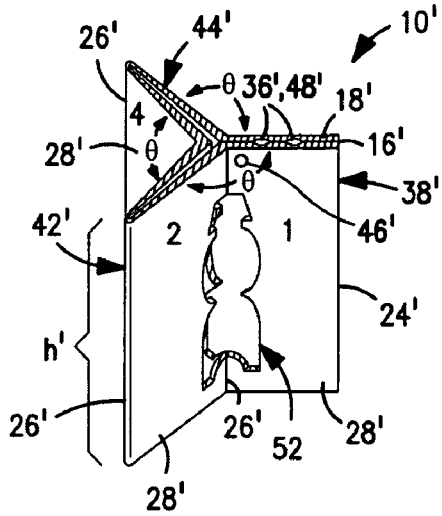
FIG. 9 is a perspective view of the snap mobile shown in FIG. 8 after the third and fourth panels are inverted onto the second and fifth panels, respectively.
Figure 10:
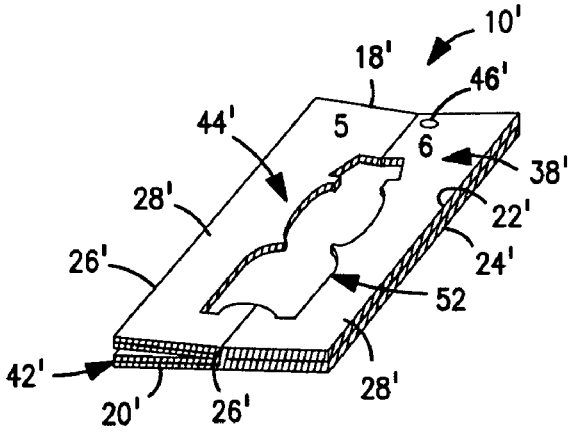
FIG. 10 is a perspective view of the snap mobile shown in FIG. 9 when in a folded configuration.

The snap mobile 10' is in its first position in FIG. 8, is in its second position in FIG. 9, and is in its third position in FIG. 10.

Returning to FIG. 8, the snap mobile 10' is shown in its first position and the various panels 28 are arranged as recited above with reference to FIG. 4. The second, third, fourth and fifth panels 28', 28', 28' and 28' (labeled #2, 3, 4 and 5) are arranged to form a hollow cavity 40'. The hollow cavity 40' has a square cross-section similar to that depicted for the hollow cavity 40. It should be understood that the cross-sectional profile of the hollow cavity 40' could be rectangular or of some other shape, if desired. Furthermore, each of the second, third, fourth and fifth panels 28', 28', 28' and 28' (labeled #2, 3, 4 and 5) are aligned at an angle θ to one another and each is aligned at an angle to the first member 38'. The second panel 28' (labeled #2) is aligned at an obtuse angle to the first panel 28' (labeled #1). The third panel 28' (labeled #3) is aligned at approximately 270° to the second panel 28' (labeled #2). The fourth panel 28' (labeled #4) is aligned at 270° to the third panel 28' (labeled #3). The fifth panel 28' (labeled #5) is aligned at 270° to the fourth panel 28' (labeled #4) and the sixth panel 28' (labeled #6) is aligned at an obtuse angle to the fifth panel 28' (labeled #5). As stated above, the snap mobile 10' can stand upright and be displayed while in its first position.

Referring to FIG. 9, the snap mobile 10' is shown in its second position. In its second position, the third and fourth panels 28', 28' (labeled #3 and 4) can be inverted onto the second and fifth panels 28', 28' (labeled #2 and 5) respectively, to create a three sided snap mobile 10'. In FIG. 9, the three members 38', 42' and 44' create a snap mobile 10' that is visible from 360 degrees. The first, second and third members, 38', 42' and 44' respectively, intersect with one another when the snap mobile 10' is transformed into this configuration. The first, second and third members, 38', 42' and 44' respectively, are aligned 120° apart from one another.

Still returning to FIGS. 7, 8 and 9, the snap mobile 10' also includes an aperture 50 formed in each of the first, second, third, fourth, fifth and sixth panels 28', 28', 28', 28', 28' and 28' (labeled #1, 2, 3, 4, 5 and 6). Each aperture 50 can be rather large. Each aperture 50 can have any desired geometrical shape and can vary in size. Each of the apertures 50 can have an identical outline. Desirably, the apertures 50, 50 formed in the first and second panels 28', 28' (labeled #1 and 2), the apertures 50, 50 formed in the third and fourth panels 28', 28' (labeled #3 and 4), and the apertures 50, 50 formed in the fifth and sixth panels 28', 28' (labeled #5 and 6) are mirror images of one another. Each of the six panels 28' has a pair of side edges and each of the apertures 50 is formed conterminous with one of the pair of side edges. As depicted, each aperture 50 is formed conterminous with the side edge defined by the score line 26' or 30'. The apertures 50 formed in the panels 28' cooperate to create a three dimensional profile 52 located at the intersection of the first, second and third members, 38', 42' and 44' respectively, when the snap mobile 10' is in its second position, see FIG. 9. This three-dimensional profile 52 can be sized and shaped to hold a three-dimensional article, not shown. The three-dimensional article would normally correspond to the printed advertisement on the snap mobile 10'.

It should be understood that the apertures 50 formed completely through each of the first, second, third, fourth, fifth and sixth panels 28', 28', 28', 28', 28' and 28' (labeled 1, 2, 3, 4, 5 and 6) are not covered by any intermediate member, such as a clear plastic film. The reason for this is that a three-dimensional article is to be easily inserted into the profile 52 created in the snap mobile 10'.

It should be mentioned that the snap mobile 10' also includes a small hole 46' formed completely through the first and sixth panels 28', 28' (labeled #1 and 6), see FIGS. 7-10. The holes 46', 46' are positioned such that when the first panel 28 (labeled #1) is overlaid on the sixth panel 28' (labeled #6) to form the first member 38', the two holes 46', 46' will overlie one another and have a common central axis, see FIGS. 8-10. Each of the holes 46', 46' is located adjacent to the top edge 18'. The hole 46' formed completely through the first member 38' provides a means for hanging the snap mobile 10' from an elevated member or structure.

Referring again to FIG. 8, one can clearly see that when the snap mobile 10' is in its first position, after the second surface 16' of the first panel 28' (labeled #1) is adhesively secured to the second surface 16' of the sixth panel 28' (labeled #6), the apertures 50, 50 formed in the third and fourth panels 28', 28' (labeled #3 and 4) cooperate to form a two-dimensional profile having a predetermined size and shape. This two-dimensional profile is capable of holding a three dimensional article (not shown). The apertures 50, 50, 50 and 50 formed in the first, second, fifth and sixth panels 28', 28', 28' and 28' (labeled #1, 2, 5 and 6) cooperate to form a three dimensional profile having a predetermined size and shape which is also capable of holding a three dimensional article therein (not shown). Therefore, when the snap mobile 10' is in its first position, it is capable of holding two three-dimensional articles. As the snap mobile 10' is manipulated to its second position, see FIG. 9, the apertures 50 cooperate to form a single three-dimensional profile which is capable of holding or retaining a single three-dimensional article.

Referring now to FIG. 10, the snap mobile 10' is shown in its third position. In its third position, the snap mobile 10' is folded into a relatively flat orientation. This is the orientation it would have prior to being shipped to a retailer or customer. The flat orientation allows multiple snap mobiles 10' to be packaged and shipped in an efficient and economical manner. As depicted, the third member 44' is folded onto the second member 42' in an overlapping fashion and both are located adjacent to the first member 38'. This produces a relatively flat, two panel wide structure which is very compact. The apertures 50 formed in the first, second and third members, 38', 42' and 44' respectively, are coaxially aligned and have coterminous edges. No intermediate material, such as a clear plastic film, covers or overlies any portion of the apertures 50 formed in the snap mobile 10'.

As stated above with reference to the snap mobile 10, the snap mobile 10' is capable of being reverted from its third position back to its second position and from its second position back to its first position. The snap mobile 10' can stand upright in either its first or second positions.

Figure 11:
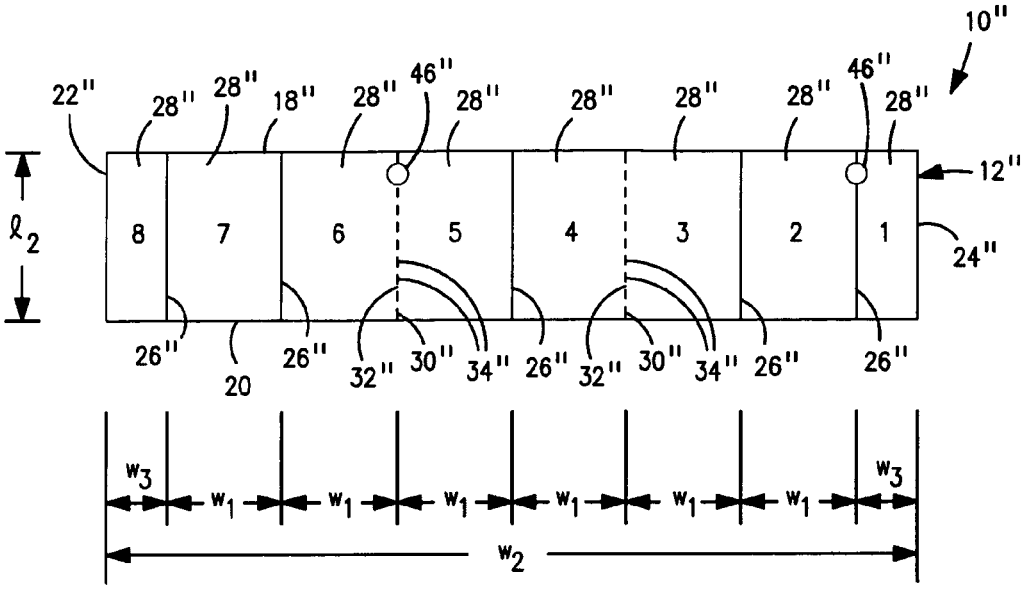
FIG. 11 is a front view of still another embodiment of a display card having eight panels and which is used to construct a snap mobile.
Figure 12:
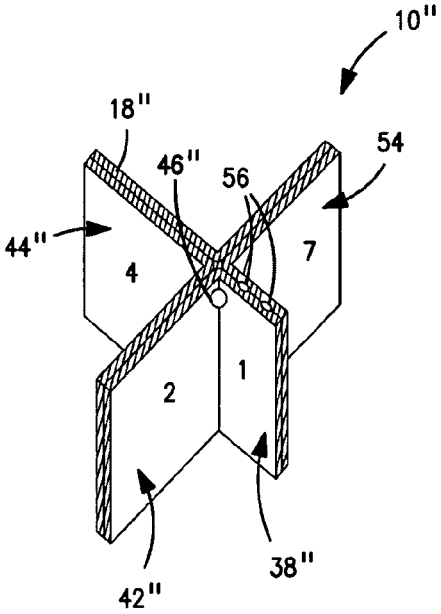
FIG. 12 is a perspective view of the snap mobile formed from the display card shown in FIG. 11 once the various panels are folded onto another panel.
Figure 13:
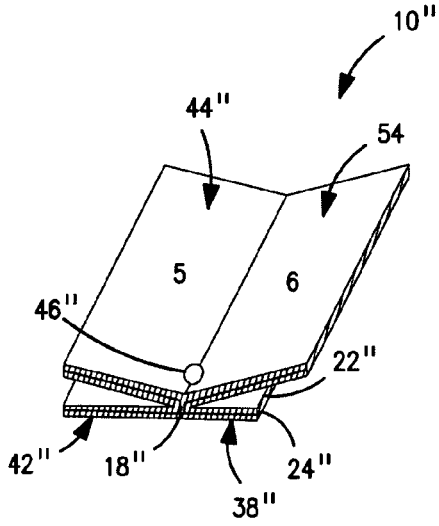
FIG. 13 is a perspective view of the snap mobile shown in FIG. 12 when in a folded configuration.

Referring now to FIGS. 11-13, a third embodiment is shown which includes a snap mobile 10" formed from a display card 12". The display card 12" has a length $l_2$ and a width $w_2$. The display card 12" also has a top edge 18", a bottom edge 20" and a pair of side edges 22" and 24". The display card 12" further has a plurality of score lines 26" which divide the width $w_2$ into eight panels 28" (labeled #1, 2, 3, 4, 5, 6, 7 and 8). Seven score lines 26" are present, two of which are constructed as intermittent score lines 30", 30". Each of the intermittent score lines 30", 30" has a plurality of land areas 32" each separated by a perforation 34". The two intermittent score lines 30", 30" are formed between the third and fourth panels 28", 28" (labeled #3 and 4) and between the fifth and sixth panels 28", 28" (labeled #5 and 6) of the display card 12". The two intermittent score lines 30", 30" facilitate inverting of the third and fourth panels 28", 28" (labeled #3 and 4) and the fifth and sixth panels 28", 28" (labeled #5 and 6) to form a four sided snap mobile 10". The display card 12" is designed to be folded such that the eighth panel 28" (labeled #8) will overlay the first panel 28" (labeled #1) and form a first member 38". The second panel 28" (labeled #2) will overlay the third panel 28" (labeled #3) to form a second member 42". The fourth panel 28", labeled #4, will overlay the fifth panel 28" (labeled #5) to form a third member 44", and the sixth panel 28" (labeled #6) will overlay the seventh panel 28" (labeled #7) to form a fourth member 54.

The snap mobile 10" is capable of moving between first, second and third positions after the first panel 28" (labeled #1) is secured to the eighth panel 28" (labeled #8). The first position is not shown in the drawings. FIG. 12 represents the second position of the snap mobile 10" and FIG. 13 represents the third position of the snap mobile 10".

Referring back to FIG. 11, the display card 12" also has a pair of small holes or apertures 46", 46" formed therethrough. The pair of holes 46", 46" can vary in size, shape and location. As shown, one of the pair of small holes 46" is located at the intersection of the first and second panels 28", 28" (labeled #1 and 2) and the other small hole 46" is located at the intersection of the fifth and sixth panels 28", 28" (labeled #5 and 6). Each of the pair of small holes 46", 46" can be located close to the top edge 18" of the display card 12". When the display card 12" is folded, the pair of small holes 46", 46" will align with one another and provide a means for passing a string or wire through them which can be used to hang the snap mobile 10" from an elevated site.

Referring to FIG. 12, the snap mobile 10" differs from the snap mobiles 10 and 10' in that its inner panels 28" (labeled #2, 3, 4, 5, 6 and 7) have a width $w_1$ while the two outer most panels 28",28" (labeled #1 and 8), have a smaller width $w_3$. This configuration produces a four sided structure wherein the first member 38" is shorter than the three remaining members 42", 44" and 54. The first and eighth panels 28", 28" (labeled #1 and 8) are secured together by an attachment mechanism 56. Desirably, the attachment mechanism 56 is an adhesive or glue.

Referring to FIG. 13, the snap mobile 10" is shown in its third position wherein it is folded into a relatively flat orientation. This is the orientation it would have prior to being shipped to a retailer or customer. The flat orientation allows multiple snap mobiles 10" to be packaged and shipped in an efficient and economical manner. As depicted, the third member 44" is folded onto the second member 42" in an overlapping fashion, and the fourth member 54 is folded onto the first member 38" in an overlapping fashion. This produces a relatively flat, two panel wide structure which is very compact.

Figure 14:
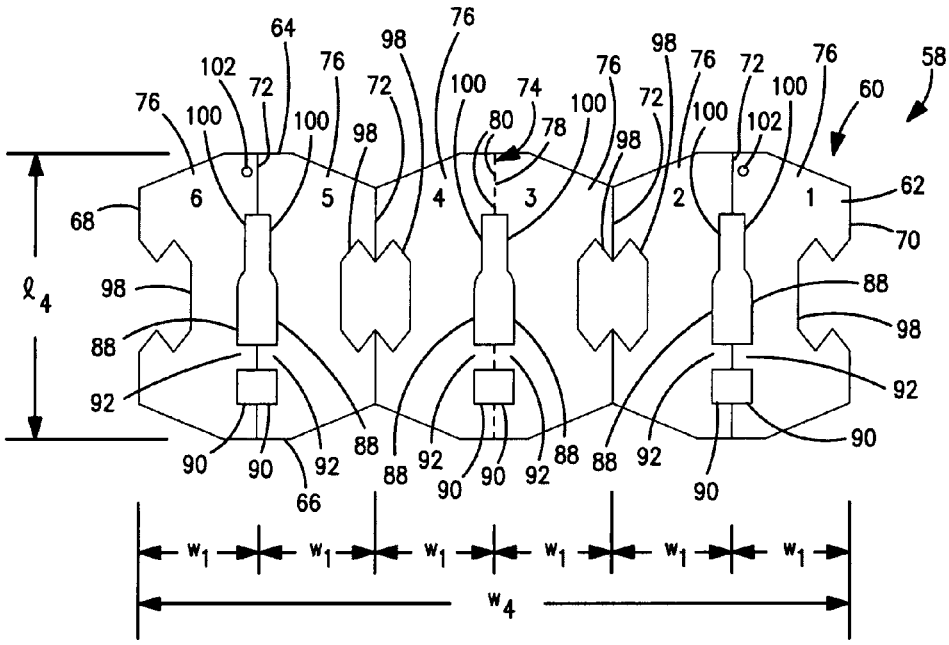
FIG. 14 is a front view of a fourth embodiment of a display card having six panels and which has non-linear side edges and an aperture formed therein.
Figure 15:
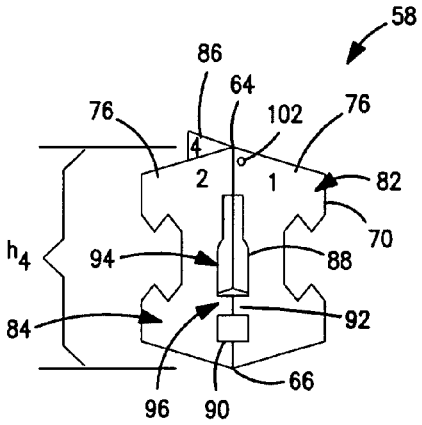
FIG. 15 is a perspective view of the snap mobile formed from the display card shown in FIG. 14 after the panels are folded into a three member configuration.
Figure 16:
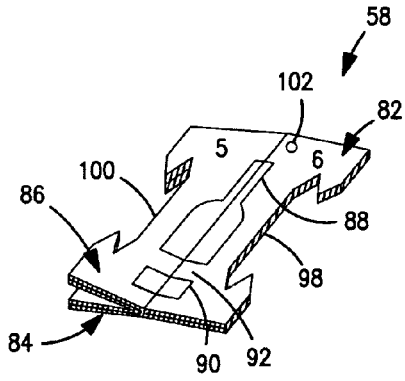
FIG. 16 is a perspective view of the snap mobile shown in FIG. 15 when in a folded configuration.

Referring now to FIGS. 14-16, a fourth embodiment of a snap mobile 58 is shown. This snap mobile 58 is formed from a display card 60 having a first surface 62 and an oppositely aligned second surface, not shown. The display card 60 has a length $l_4$, a width $w_4$, and a thickness t, not shown. The length $l_4$, the width $w_4$ and the thickness t can vary in dimension. The first surface 62 contains printed matter while the oppositely aligned second surface can be void of printed matter or may contain printed matter. The display card 60 has a top edge 64, a bottom edge 66, and a pair of side edges 68 and 70. The display card 60 has a width $w_4$ divided by at least five score lines 72 and 74 into a first panel 76, a second panel 76, a third panel 76, a fourth panel 76, a fifth panel 76 and a sixth panel 76. The panels 76 are (labeled #1, 2, 3, 4, 5, and 6). The first and sixth panels 76, 76 (labeled #1 and 6) have an equal width $w_1$, the second and third panels 76, 76 (labeled #2 and 3) have an equal width $w_1$, and the fourth and fifth panels 76, 76 (labeled #4 and 5) have an equal width $w_1$. In this embodiment, as in FIG. 1, all six panels 76 have the same width $w_1$. However, it should be understood that various pair of panels 76, 76 can be sized to have a different width.

One of the score lines 72 is an intermittent score line 74 having a plurality of land areas 78 each separated by a perforation 80. It should be understood that the intermittent score line 74 can be replaced by the continuous score line 72, if desired. The intermittent score line 74 is formed at a midsection of the width $w_4$ of the display card 60. The intermittent score line 74 facilitates inverting the third and fourth panels 76, 76 (labeled #3 and 4) relative to the second and fifth panels 76, 76 (labeled #2 and 5) of the snap mobile 58.

The snap mobile 58 is capable of acquiring three separate and distinct positions referred to as a first position, a second position and a third position after the first panel 76 (labeled #1) is secured to the sixth panel 76 (labeled #6). The first position is not shown in the drawings. The second position is shown in FIG. 15 and the third position is shown in FIG. 16.

Referring now to FIG. 15, the score lines 72 and 74 allow the snap mobile 58 to be folded such that the sixth panel 76 can overlay the first panel 76. The second surface of the first panel 76 (labeled #1) can be secured to the second surface of the sixth panel 76 (labeled #6) by an attachment mechanism, such as an adhesive or glue, not shown. When the attachment mechanism is an adhesive, it can be applied by any means known to those skilled in the art. The adhesive can be applied to a portion of or cover the entire second surface located between the first and sixth panels 76, 76 (labeled #1 and 6). Desirably, to reduce cost, only a portion of the second surface, located between the first and sixth panels 76, 76, labeled #1 and 6, has adhesive applied to it. Once the first and sixth panels 76, 76 (labeled #1 and 6), are joined together, a first member 82 is formed. As explained above with reference to FIGS. 1-6, the third panel 76 (labeled #3) is overlaid on the second panel 76 (labeled #2) to form a second member 84, and the fourth panel 76 (labeled #4) is overlaid on the fifth panel 76 (labeled #5) to form a third member 86. The third and fourth panels 76, 76 (labeled #3 and 4), can be inverted onto the second and fifth panels 76, 76 (labeled #2 and 5) respectively, to create a three sided snap mobile 58. In FIG. 15, the three members 82, 84 and 86 create a snap mobile 58 that is visible from 360 degrees. The first, second, third members, 82, 84 and 86 respectively, intersect one another when the snap mobile 58 is configured as shown in FIG. 15. The first, second, third members, 82, 84 and 86 respectively, are space 120° apart.

Still referring to FIG. 15, the snap mobile 58 has an overall height $h_4$. The snap mobile 58 also has a first aperture 88 and a second aperture 90 formed in each of the six panels 76. Each of the first and second apertures, 88 and 90 respectively, has an edge conterminous with one of the score lines 72 or 74. The first and second apertures, 88 and 90 respectively, are each separated by a land area 92. The first and second apertures, 88 and 90 respectively, formed in each panel 76 cooperate to create a three dimensional profile 94 located at the intersection of the first, second and third members, 82, 84 and 86 respectively. The land areas 92 cooperate to form a ring 96 around the three dimensional profile 94 when the first, second and third members, 82, 84 and 86 respectively, are aligned at approximately 120 degrees to one another. A three dimensional article, not shown, can be positioned in the three dimensional profile 94. The function of the ring 96 is to retain the three dimensional article in an upright orientation within the three dimensional profile 94. For example, a bottle of wine could be inserted into the three dimensional profile 94 and be retained in an upright position by the ring 96. This feature allows an actual product to be displayed in combination with the snap mobile 58.

The snap mobile 58 further includes a first, non-linear side edge 98 and a second non-linear side edge 100. The first, non-linear side edge 98 is different in design and profile from the second non-linear side edge 100. Any desired profile can be used for the first and second side edges, 98 and 100 respectively. Lastly, the snap mobile 58 can optionally include one or more small holes or openings 102 formed approximate the top edge 64. A hole 102 is depicted which extends completely through the thickness t of the first panel 76 (labeled #1) and a second hole 102 is depicted which extends completely through the thickness t of the sixth panel 76 (labeled #6). The two small holes 102, 102 are formed at locations such that when the sixth panel 76 (labeled #6), is folded and overlaid onto the first panel 76 (labeled #1) the two small holes 102, 102 will coaxially align with one another. In other words, the two holes 102, 102 create a single opening in the first member 82 approximately at the point where the first, second and third members, 82, 84 and 86 respectively, intersect. It should be understood that one or more small holes 102 can be formed through one or more of the other panels 76, if desired. The small holes 102, 102 can be formed in the display card 60 before or after it is printed or in the snap mobile 58 after it is configured into the profile shown in FIG. 15. The two small holes 102, 102 are sized to receive a string, cord, wire, etc. so that the snap mobile 58 can be hung from an elevated member or structure. The elevated member or structure can be a ceiling, a rafter, a beam, the top of a display cabinet, etc., or a hook extending downward from such a structure.

Referring to FIG. 16, the snap mobile 58 is shown in its third position. In its third position, the snap mobile 58 is folded into a relatively flat orientation. This is the orientation it would have prior to being shipped to a retailer or customer. The flat orientation allows multiple snap mobiles 58 to be packaged and shipped in an efficient and economical manner. As depicted, the third member 86 is folded onto the second member 84 in an overlapping fashion and both are located adjacent to the first member 82. This produces a relatively flat, two panel wide structure which is very compact.

As stated above, the snap mobile 58 can be manipulated from its first position to its second position and then to its third position. Likewise, the snap mobile 58 can revert from its third position back to its second position and then back to its first position. The snap mobile 58 cannot directly be transformed from its third position to its first position without first going through its second position. The snap mobile 58 can stand upright in either its first or second positions.

Figure 17:
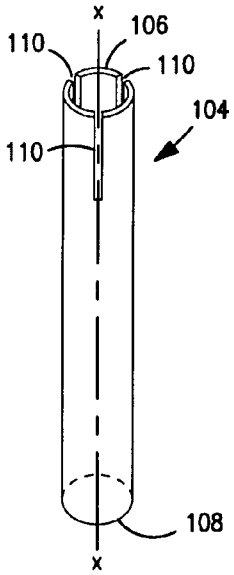
FIG. 17 is a perspective view of an elongated, hollow tube having three slits formed in an end thereof for supporting a three member snap mobile.

Referring to FIG. 17, an elongated hollow tube 104 is depicted having a longitudinal central axis X-X. The hollow tube 104 can be formed out of various materials, with plastic being a desired material. Plastic is relatively inexpensive to manufacture and it can be easily machined. The hollow tube 104 can be formed from clear or transparent plastic, from opaque plastic or from a color plastic. The hollow tube 104 has a first end 106 and an oppositely aligned second end 108. One or more slits 110 are machined or formed in the first end 106. In FIG. 17, three vertical slits 110 are formed in the first end 106. It should be noted that the slits 110 can be formed at an acute angle to the first end 106, if desired. Each slit 110 is spaced at an angle from an adjacent slit 110. Desirably, the three slits 110 are spaced about 120 degrees apart from one another. The depth of each slit 110 should be approximately the same, although they can be different, if desired. The overall depth can vary to suit one's intended needs. The first or upper end 106 of the hollow tube 104 is designed to receive and hold a snap mobile. The three slits 110, 110, 110 are designed to receive the first, second and third members, 38, 42 and 44 respectively, of a three sided snap mobile. If a four sided snap mobile is being displayed, four slits 110 can be formed in the first end 106 of the hollow tube 104. For a four side snap mobile, each slit 110 is spaced about 90 degrees apart. If the snap mobile has five sides, five slits 110 can be formed in the first end 106 of the hollow tube 104 each being spaced about 72 degrees apart. Depending upon the size of a particular snap mobile, each slit 110 should be at least about 2 inches in length. Desirably, each slit 110 is at least 2.5 inches in length. More desirably, each slit 110 is at least 3 inches in length. The overall length of the hollow tube 104 can also vary. Typically, such hollow tubes 104 are produced in 12, 18, 24, 30 and 36 inch lengths, etc. However, the hollow tube 104 can be made to any specific length.

Figure 18:
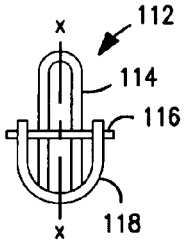
FIG. 18 is a front view of a fastener which can be secured to the side wall of a carton to support the hollow tube shown in FIG. 17 in a vertical orientation.
Figure 19:
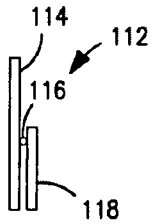
FIG. 19 is a side view of the fastener shown in FIG. 18.
Figure 20:
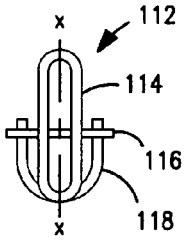
FIG. 20 is a back view of the fastener shown in FIG. 18.

Referring to FIGS. 18-20, the second end 108 of the hollow tube 104 is designed and sized to receive a fastener 112. The fastener 112 can be made to various constructions and designs. One specific design is depicted as having a narrow, elongated oval shaped member 114. The width of the oval shaped member 114 is sized to fit snuggly into the hollow tube 104. For a hollow tube 104 having an outer diameter of about 1⅛ inches and an inner diameter of about ⅞ of an inch, the oval shaped member 114 can have a width ranging from about 13/16 to about ⅞ of an inch. The oval shaped member 114 is secured to a horizontal member 116. The horizontal member 116 can have a length of at least about 2 inches, desirably a length of at least about 3 inches, and more desirably, a length of at least about 4 inches. In turn, a U-shaped member 118 is secured to an opposite side of the horizontal member 116 such that a bottom surface of the U-shaped member 118 and a bottom surface of the oval shaped member 114 are aligned in a common plane. The legs of the U-shaped member 118 can be spaced at about 1⅝ inches apart. All three members 114, 116 and 118 can be formed from metal, steel or any other sturdy material known to those skilled in the art. The three members 114, 116 and 118 can be formed from solid tube stock having a predetermined diameter ranging from about 0.1 inch to about 0.5 inches. Diameters of about 0.25 or 0.375 inches work well for the three members 114, 116 and 118. Likewise, all three members 114, 116 and 118 can be formed from bar stock having a square or rectangular cross-section. In addition, the three members 114, 116 and 118 can be formed to any desired geometrical configuration. The oval shaped member 114 and the U-shaped member 116 are spaced apart from one another by the diameter or width of the horizontal member 116.

Figure 21:
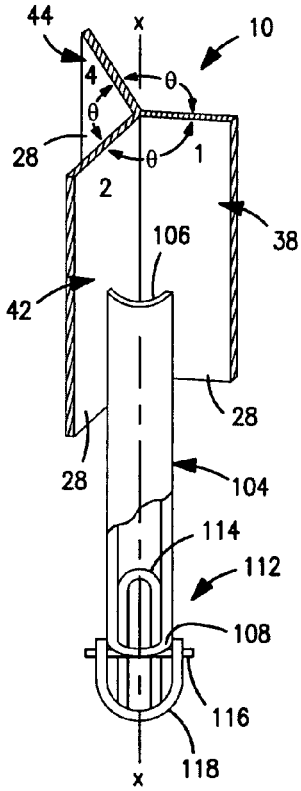
FIG. 21 is an assembly view of a snap mobile being vertically supported on the hollow tube, shown in FIG. 17, and partially sectioned so as to show how it is attached to the fastener, shown in FIG. 18.
Figure 22:
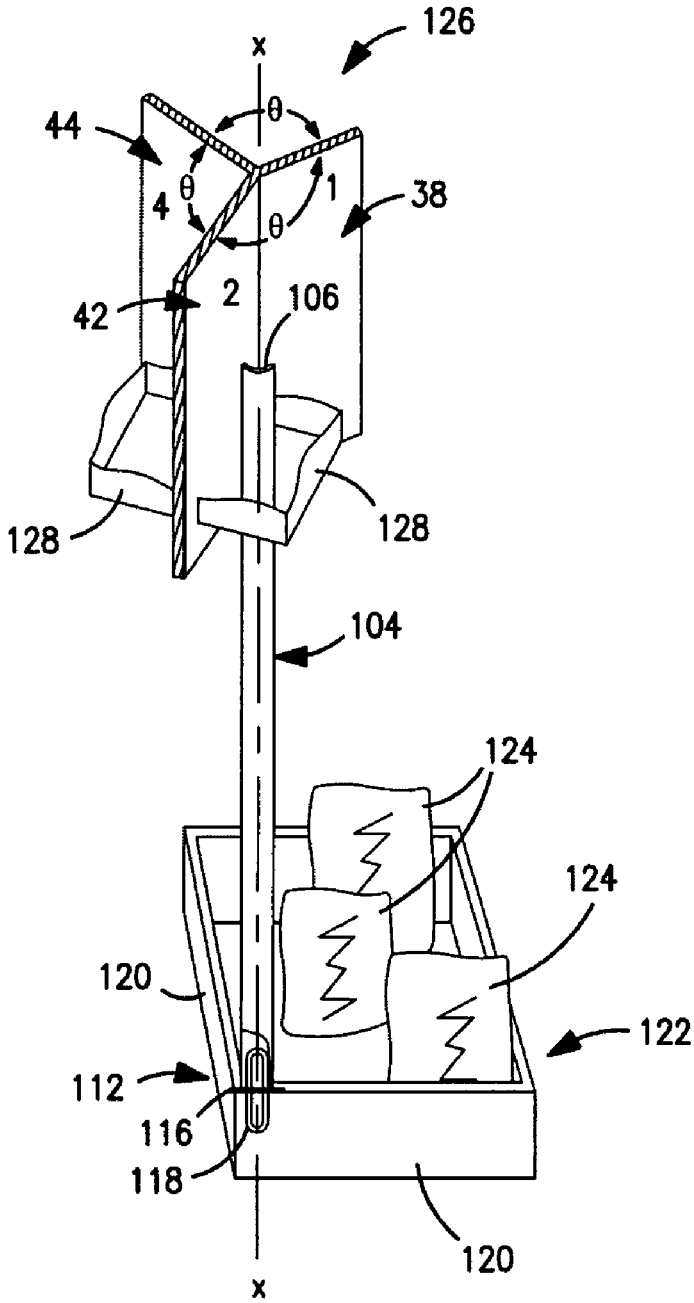
FIG. 22 is an assembly view of a box of flexible packages and having a snap mobile positioned vertically above the box by the hollow tube shown in FIG. 17 and which is attached to the fastener shown in FIG. 18.

Referring to FIGS. 21 and 22, the oval shaped member 114 is slid into the second end 108 of the hollow tube 104 until the horizontal member 116 contacts the second end 108. In FIG. 21, the hollow tube 104 is made from clear plastic so that one can see the fastener 112. The opposite or lower end of the fastener 112 is designed to slide over a side wall 120 of a cardboard box or carton 122. The box 122 is sized and configured to hold or retain a plurality of products or articles 124. In FIG. 22, the products are depicted as flexible packages, similar to potato chip bags.

In FIG. 21, a three side snap mobile 10 is shown being supported by the elongated, hollow tube 104. The ability of the hollow tube 104 to advertise a particular product 124 at eye level or above can facilitate the sale of the product 124 for it will attract the attention of the consumer.

In FIG. 22, a three sided snap mobile 126 is shown which has a lower portion 128 cut and pulled outward away from the remainder of the snap mobile 126. This design may create an aesthetically pleasing presentation for a particular product.

Referring now to FIGS. 23-29, another embodiment of a snap mobile 130 is shown for advertising a product or event. The snap mobile 130 is formed from a display card 132 formed from a single material having a first printed surface and an oppositely aligned second surface. The display card 132 has a length $l_5$ and a width $w_5$, see FIG. 23, and a thickness $t_5$, see FIG. 25. The width $w_5$ is greater than the length $l_5$. The width $w_5$ is divided by at least five score lines 134, 134, 134, 134 and 134. One of the score lines 134 is an intermittent score line 136. The four score lines 134, 134, 134 and 134 and the intermittent score line 136 are aligned parallel to the length $l_5$. The five score lines 134, 134, 134, 134 and 136 divide the width $w_5$ of the display card 132 into a first panel 138 (labeled #1), a second panel 138 (labeled #2), a third panel 138 (labeled #3), a fourth panel 138 (labeled #4), a fifth panel 138 (labeled #5) and a sixth panel 138 (labeled #6). Each of the six panels 138 is shown having an equal width $w_6$. However, the first and sixth panels 138, 138 (labeled #1 and 6) can have an equal width, while the second and fifth panels 138, 138 (labeled #2 and 5) can each have a width which is different from the width of the first and sixth panels 138, 138 (labeled #1 and 6), and the third and fourth panels 138, 138 (labeled #3 and 4) can have a width which is different from the widths of the first, second, fifth and sixth panels 138, 138, 138 and 138 (labeled #1, 2, 5 and 6), if desired. The width of the second panel 138 (labeled #2) should be equal to the width of the fifth panel 138 (labeled #5), while the width of the third panel 138 (labeled #3) should be equal to the width of the fourth panel 138 (labeled #4).

Figure 23:
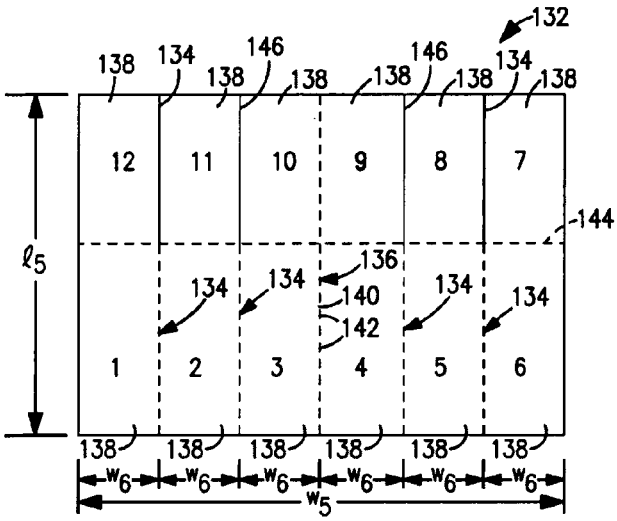
FIG. 23 is a front view of a display card having twelve panels and which is used to construct a flip up snap mobile.

Still referring to FIG. 23, each of the at least five score lines 134, 134, 134, 134 and 136 extend approximately parallel to one another. The intermittent score line 136 is formed at a midsection of the width $w_5$ of the display card 132. The intermittent score line 136 has a plurality of land areas 140 each separated by a perforation 142 which extends completely through the thickness of the display card 132. The other score lines 134, 134, 134 and 134 do not have perforations 142 which extend completely through the thickness $t_5$ of the display card 132. The intermittent score line 136 permits the fourth, fifth and sixth panels 138, 138 and 138 (labeled #4, 5 and 6) to be folded or inverted onto the first, second and third panels 138, 138 and 138 (labeled #1, 2 and 3) and permit the seventh, eighth and ninth panels 138, 138 and 138 (labeled #7, 8 and 9) to be folded or inverted onto the tenth, eleventh and twelfth panels 138, 138 and 138 (labeled #10, 11 and 12).

Figure 24:
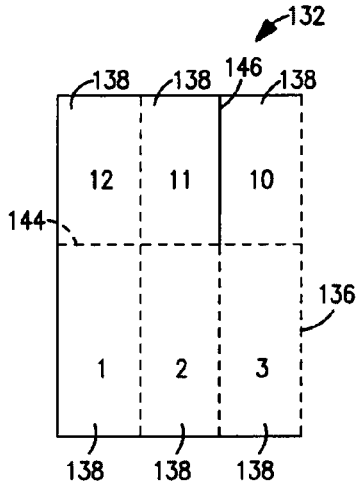
FIG. 24 is a front view of the display card shown in FIG. 23 after it has been folded in half along an intermittent score line located at the midpoint of its width.

Referring to FIG. 24, the display card 132 is depicted after it has been folded along the intermittent score line 136 which is located at the midsection of the width $w_5$.

Still referring to FIGS. 23 and 24, the display card 132 also has a horizontal score line 144. The horizontal score line 144 divides the length $l_5$ of the display card 132 into two parts so that panels 138, 138, 138, 138, 138 and 138 (labeled #7, 8, 9, 10, 11 and 12) are formed. Each of the panels 138, 138, 138, 138, 138 and 138 (labeled #7-12) are of the same size. However, the panels 138, 138, 138, 138, 138 and 138 (labeled #7-12) can be smaller than, equal to or be larger than the panels 138, 138, 138, 138, 138 and 138 (labeled 1-6). In FIGS. 23 and 24, each of the panels 138, 138, 138, 138, 138 and 138 (labeled 7-12) are smaller than each of the panels 138, 138, 138, 138, 138 and 138 (labeled 1-6). The display card 132 also has a pair of cut lines 146, 146 located between the panels 138, 138, 138 and 138 (labeled #8 and 9 and 10 and 11). These pair of cut lines 146, 146 permit the panel 138 (labeled #8) to be separated from the panel 138 (labeled #9) and permit the panel 138 (labeled #10) to be separated from the panel 138 (labeled #11). This arrangement permits some of the panels 138 to flip up relative to other panels 138 and this will be described in more detail below.

Figure 25:
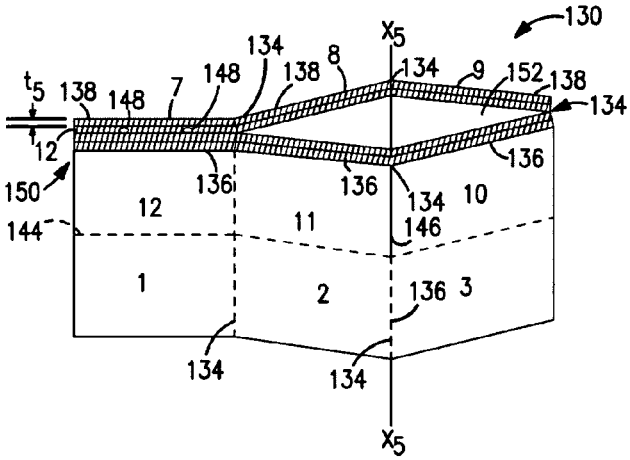
FIG. 25 is a perspective view showing the flip up snap mobile formed from the folded display card shown in FIG. 24 depicting the flip up snap mobile in its first position.

Referring now to FIG. 25, an adhesive 148 is used to secure the second surface of the first panel 138 (labeled #1) to the second surface of the sixth panel 138 (labeled #6). Two lines of adhesive 148, 148 are shown. However, the amount and location of the adhesive 148, and well as the fashion of how the adhesive 148 is applied can vary as is known to one skilled in the art. Once the sixth panel 138 (labeled #6) is overlaid onto the first panel 138 (labeled #1) and is secure by the adhesive 148, a first member 150 is formed.

Figure 26:
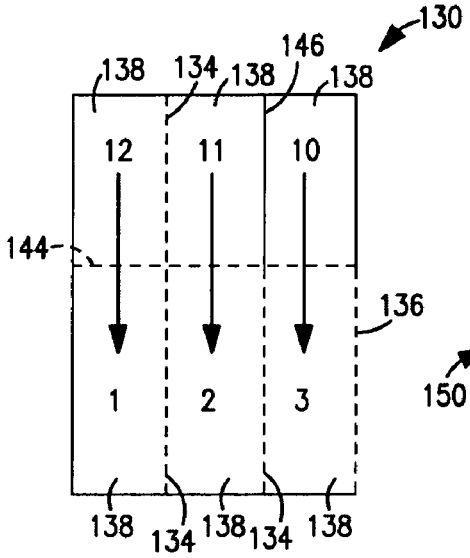
FIG. 26 is a front view of the flip up snap mobile before it is folded in half along an intermittent score line located at the midpoint of its height.
Figure 27:
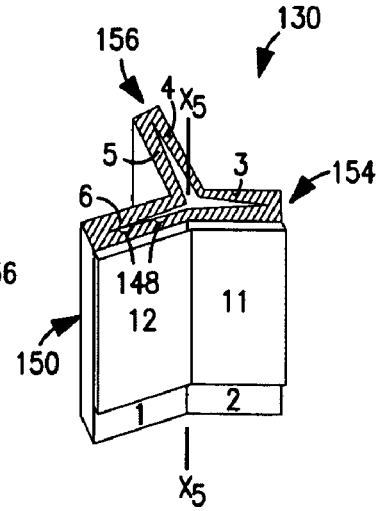
FIG. 27 is a perspective view of the flip up snap mobile when it is in its second position.

The second, third, fourth and fifth panels 138, 138, 138 and 138 (labeled #2, 3, 4 and 5) are capable of moving relative to one another to enable the snap mobile 130 to acquire three separate and distinct positions. The three positions are referred to as a first position, a second position and a third position. The three positions can be created after said first member 150 is formed. FIG. 25 depicts the snap mobile 130 in its first position. In this first position, the snap mobile 130 can stand upright by itself. In addition, the first surface of the second panel 138 (labeled #2) is aligned at an obtuse angle to the first surface of the first panel 138 (labeled #1), the first surface of the third panel 138 (labeled #3) is aligned at a reflex angle to the first surface of the second panel 138 (labeled #2), the first surface of the fourth panel 138 (labeled #4) is aligned at a reflex angle to the first surface of the third panel 138 (labeled #3), the first surface of the fifth panel 138 (labeled #5) is aligned at a reflex angle to the first surface of the fourth panel 138 (labeled #4), and the first surface of the sixth panel 138 (labeled #6) is aligned at an obtuse angle to the first surface of the fifth panel 138 (labeled #5) to form a hollow cavity 152 completely surrounded by the second, third, fourth and fifth panels 138, 138, 138 and 138 (labeled #2, 3, 4 and 5). The hollow cavity 152 has a central axis $X_5$-$X_5$ which is aligned parallel to the height of the first member 150. Referring now to FIGS. 26 and 27, the snap mobile 130 can be arranged into its second position, shown in FIG. 27, by folding the panels 138, 138 and 138 (labeled #12, 11 and 10) downward over the panels 138, 138 and 138 (labeled #1, 2 and 3) and then manipulating, such as by pushing or pressing, the third panel 138 (labeled #3) against the second panel 138 (labeled #2) to form a second member 154 and manipulating the fourth panel 138 (labeled #4) against the fifth panel 138 (labeled #5) to form a third member 156. In this second position, the first, second and third members 150, 154 and 156 are aligned at 120° relative to each other. In addition, the second, third, fourth and fifth panels 138, 138, 138 and 138 (labeled #2, 3, 4 and 5) are void of any attachment mechanism 148 which would directly secure the second panel 138 (labeled #2) to the third panel 138 (labeled #3) and the fourth panel 138 (labeled #4) to the fifth panel 138 (labeled #5).

Figure 28:
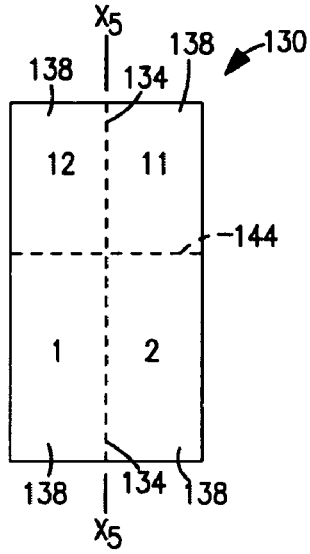
FIG. 28 is a front view of the flip up snap mobile depicting the eleventh and twelfth panels being flipped up relative to the first and second panels.
Figure 29:
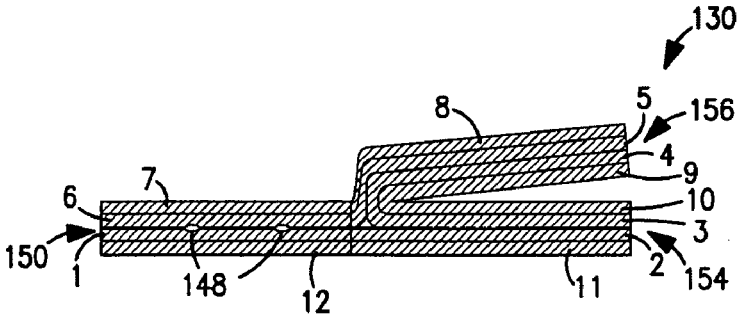
FIG. 29 is a perspective view of the flip up snap mobile when it is in its third position.

Referring now to FIGS. 28 and 29, the snap mobile 130 is depicted in its third position. In the third position, the third member 156 overlays and is aligned at an acute angle to the second member 154. In addition, the second and third members, 154 and 156 respectively, are aligned adjacent to said first member 150. This third position facilitates shipping the snap mobile 130 to a retailer or customer.

The snap mobile 130 can be manipulated so that it can revert from its third position back to its second position, and revert from its second position back to its first position. The snap mobile 130, as well the other snap mobiles 10, 10", 10" and 58 explained above, can transition back and forth between the first position and the third position multiple times, always going through the second position.

While the invention has been described in conjunction with several specific embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

I claim:

1. A snap mobile for advertising a product or event, comprising:

a) a display card formed from a single material having a first printed surface and an oppositely aligned second surface, said display card having a length, a width and a thickness, said width being greater than said length, said width being divided by at least five score lines into a first panel, a second panel, a third panel, a fourth panel, a fifth panel and a sixth panel, said first and sixth panels having an equal width, each of said score lines extending along said length of said display card, and one of said at least five score lines is formed at a midsection of said width of said display card, said score line formed at said midsection being an intermittent score line having a plurality of land areas each separated by a perforation which extends completely through said thickness, said intermittent score line permitting said third and fourth panels to be inverted onto said second and fifth panels;

b) an adhesive securing said second surface of said first panel to said second surface of said sixth panel once said sixth panel is overlaid onto said first panel to form a first member, and said first member having a height equal to said length of said display card and said first member having a top edge;

c) said second, third, fourth and fifth panels capable of moving relative to one another to enable said snap mobile to acquire three separate and distinct first, second and third positions after said first member is formed; when said snap mobile is in said first position, said first surface of said second panel is aligned at an angle to said first surface of said first panel, said first surface of said third panel is aligned at a reflex angle to said first surface of said second panel, said first surface of said fourth panel is aligned at a reflex angle to said first surface of said third panel, said first surface of said fifth panel is aligned at a reflex angle to said first surface of said fourth panel, and said first surface of said sixth panel is aligned at an angle to said first surface of said fifth panel to form a hollow cavity completely surrounded by said second, third, fourth and fifth panels, said hollow cavity having a central axis aligned parallel to said height of said first member, when said snap mobile is in said second position, said second panel overlays said third panel to form a second member and said fourth panel overlays said fifth panel to form a third member, and said first, second and third members are aligned at 120° relative to each other, and said second, third, fourth and fifth panels are void of any attachment mechanism which would directly secure said second panel to said third panel and said fourth panel to said fifth panel, and when said snap mobile is in said third position, said second member overlays said third member and said second and third members are aligned adjacent to said first member, said third position facilitating shipping said snap mobile; and d) an elongated, hollow tube having a first end with three slits formed therein, each slit being sized and shaped to receive one of said first, second and third members.

2. The snap mobile of claim 1 wherein after said snap mobile is manipulated to said third position, said snap mobile can be reverted back to said second position.

3. The snap mobile of claim 2 wherein a hole is formed completely through said first member adjacent to said top edge such that said snap mobile can be hung by a string from an elevated member when said snap mobile is in said first and second positions.

4. The snap mobile of claim 1 wherein after said snap mobile is manipulated to said second position, said snap mobile can be reverted back to said first position.

5. The snap mobile of claim 1 wherein when said snap mobile is in said first position, said hollow cavity forms a three dimensional profile having a predetermined size and shape which is stable and can support itself on a flat, horizontal surface.

6. The snap mobile of claim 1 wherein when said snap mobile is in said third position, said third member overlies said second member and said second and third members are aligned adjacent to said first member to form a relatively flat snap mobile which can be easily shipped.

7. The snap mobile of claim 1 wherein said snap mobile can be manipulated into said third position only after it has been manipulated into said second position.

8. The snap mobile of claim 1 wherein said snap mobile can be manipulated from said first position into said second position and from said second position back to said first position without ever being manipulated into said third position.

9. The snap mobile of claim 1 wherein said each of said first, second, third, fourth, fifth and sixth panels has a pair of side edges, an aperture is formed in each of said panels conterminous with one of said pair of side edges, and each aperture extends from said first surface to said second surface free of any intermediate material.

10. A snap mobile for advertising a product or event, comprising:

a) a display card formed from a single material having a first printed surface and an oppositely aligned second surface, said display card having a length, a width and a thickness, said width being greater than said length, said width being divided by at least five score lines into a first panel, a second panel, a third panel, a fourth panel, a fifth panel and a sixth panel, said first and sixth panels having an equal width, each of said score lines extending along said length of said display card, one of said at least five score lines is formed at a midsection of said width of said display card, said score line formed at said midsection being an intermittent score line having a plurality of land areas each separated by a perforation which extends completely through said thickness, said intermittent score line permitting said third and fourth panels to be inverted onto said second and fifth panels;

b) an adhesive securing said second surface of said first panel to said second surface of said sixth panel once said sixth panel is overlaid onto said first panel to form a first member, and said first member having a height equal to said length of said display card and said first member having a top edge;

c) said second, third, fourth and fifth panels capable of moving relative to one another to enable said snap mobile to acquire three separate and distinct first, second and third positions after said first member is formed; when said snap mobile is in said first position, said first surface of said second panel is aligned at an obtuse angle to said first surface of said first panel, said first surface of said third panel is aligned at a reflex angle to said first surface of said second panel, said first surface of said fourth panel is aligned at a reflex angle to said first surface of said third panel, said first surface of said fifth panel is aligned at a reflex angle to said first surface of said fourth panel, and said first surface of said sixth panel is aligned at an obtuse angle to said first surface of said fifth panel to form a hollow cavity completely surrounded by said second, third, fourth and fifth panels, said hollow cavity having a central axis aligned parallel to said height of said first member, when said snap mobile is in said second position, said second panel overlays said third panel to form a second member and said fourth panel overlays said fifth panel to form a third member, and said first, second and third members are aligned at 120° relative to each other, and said second, third, fourth and fifth panels are void of any attachment mechanism which would secure said second panel to said third panel and said fourth panel to said fifth panel, and when said snap mobile is in said third position, said second member overlays said third member and said second and third members are aligned adjacent to said first member, said third position facilitating shipping said snap mobile;

d) an aperture formed in each of said first, second, third, fourth, fifth and sixth panels, each of said apertures having an identical outline and when said snap mobile is in said first position, said apertures in said third and fourth panels cooperate to form a two-dimensional profile having a predetermined size and shape which is capable of holding a three dimensional article, and said apertures in said first, second, fifth and sixth panels cooperate to form a three dimensional profile having a predetermined size and shape which is capable of holding a three dimensional article therein; and e) an elongated, hollow tube having a first end with three slits formed therein, each slit being sized and shaped to receive one of said first, second and third members.

11. The snap mobile of claim 10 wherein when said snap mobile is in said first position, said hollow cavity has a square cross-section and said snap mobile has the ability to stand upright on a horizontal surface, and said snap mobile can be manipulated from said first position into said second position wherein said snap mobile has the ability to stand upright on a horizontal surface, and said snap mobile can then be reverted from said second position back to said first position.

12. The snap mobile of claim 11 wherein said elongated, hollow tube is attached to the snap mobile to raise it vertically above products which are being advertised for sale.

13. The snap mobile of claim 12 wherein said elongated hollow tube has a second end aligned opposite to said first end, and a fastener is inserted into said second end and is secured to a box of products.

14. The snap mobile of claim 13 wherein said fastener includes an oval shaped member secured to a horizontal member, a U-shaped member secured to an opposite side of said horizontal member, and wherein a bottom surface of said oval shaped member is aligned in a common plane with a bottom surface of said U-shaped member.

15. The snap mobile of claim 11 wherein each of said panels has a first non-linear side edge, an oppositely aligned second non-linear side edge, and said first side edge is different in profile from said second side edge.

16. A snap mobile for advertising a product or event, comprising:

a) a display card formed from a single material having a first printed surface and an oppositely aligned second surface, said display card having a length, a width and a thickness, said width being greater than said length, said width being divided by at least five score lines into a first panel, a second panel, a third panel, a fourth panel, a fifth panel and a sixth panel, said first and sixth panels having an equal width, each of said score lines extending along said length of said display card, one of said at least five score lines is formed at a midsection of said width of said display card, said score line formed at said midsection being an intermittent score line having a plurality of land areas each separated by a perforation which extends completely through said thickness, said intermittent score line permitting said third and fourth panels to be inverted onto said second and fifth panels;

b) an adhesive securing said second surface of said first panel to said second surface of said sixth panel once said sixth panel is overlaid onto said first panel to form a first member, and said first member having a height equal to said length of said display card and said, first member having a top edge;

c) said second, third, fourth and fifth panels capable of moving relative to one another to enable said snap mobile to acquire three separate and distinct first, second and third positions after said first member is formed; when said snap mobile is in said first position, said first surface of said second panel is aligned at an angle to said first surface of said first panel, said first surface of said third panel is aligned at a reflex angle to said first surface of said second panel, said first surface of said fourth panel is aligned at a reflex angle to said first surface of said third panel, said first surface of said fifth panel is aligned at a reflex angle to said first surface of said fourth panel, and said first surface of said sixth panel is aligned at an angle to said first surface of said fifth panel to form a hollow cavity completely surrounded by said second, third, fourth and fifth panels, said hollow cavity having a central axis aligned parallel to said height of said first member, when said snap mobile is in said second position, said second panel overlays said third panel to form a second member and said fourth panel overlays said fifth panel to form a third member, and said first, second and third members are aligned at 120° relative to each other, and said second, third, fourth and fifth panels are void of any attachment mechanism which would secure said second panel to said third panel and said fourth panel to said fifth panel, and when said snap mobile is in said third position, said second member overlays said third member and said second and third members are aligned adjacent to said first member, said third position facilitating shipping said snap mobile;

d) a hole formed completely through said first member adjacent to said top edge such that said snap mobile can be hung by a string from an elevated member while in either said first and second positions; and e) an elongated, hollow tube having a first end with three slits formed therein, each slit being sized and shaped to receive one of said first, second and third members.

17. The snap mobile of claim 16 wherein when said snap mobile is in said first position, said hollow cavity forms a three dimensional profile having a predetermined size and shape which is stable and can support itself on a flat, horizontal surface, and said snap mobile can be manipulated into said second position and can later be reverted from said second position back to said first position.

18. The snap mobile of claim 16 wherein said snap mobile can be manipulated from said third position back to said second position, and from said second position back to said first position.

19. The snap mobile of claim 16 wherein said snap mobile can be manipulated from said first position into said second position and from said second position back to said first position without ever being manipulated into said third position.

20. The snap mobile of claim 16 wherein said hollow tube has a second end oppositely aligned to said first end, and a fastener inserted into said second end of said hollow tube which can support said hollow tube in an upright fashion on a side wall of a carton.

* * * * *